US011788426B2

(12) United States Patent
Mathews, Jr. et al.

(10) Patent No.: US 11,788,426 B2
(45) Date of Patent: Oct. 17, 2023

(54) CLEARANCE CONTROL FOR ENGINE PERFORMANCE RETENTION

(71) Applicant: General Electric Company, Schenectady, NY (US)

(72) Inventors: Harry Kirk Mathews, Jr., Clifton Park, NY (US); Eric Richard Westervelt, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/686,537

(22) Filed: Mar. 4, 2022

(65) Prior Publication Data

US 2023/0279782 A1 Sep. 7, 2023

(51) Int. Cl.
*F01D 11/24* (2006.01)
*F01D 21/00* (2006.01)

(52) U.S. Cl.
CPC ..... *F01D 11/24* (2013.01); *F01D 21/003* (2013.01); *F05D 2260/232* (2013.01); *F05D 2260/821* (2013.01); *F05D 2270/305* (2013.01); *F05D 2270/44* (2013.01); *F05D 2270/71* (2013.01)

(58) Field of Classification Search
None
See application file for complete search history.

(56) References Cited

U.S. PATENT DOCUMENTS 6,463,380 B1 10/2002 Ablett et al.
8,000,930 B2 8/2011 Poncet et al.
8,186,945 B2 5/2012 Bhatnagar et al.
9,014,945 B2 4/2015 Abrol et al.
10,087,772 B2 * 10/2018 Sun ..... F01D 11/24
10,378,376 B2 8/2019 Adibhatla
10,754,332 B2 8/2020 Tani et al.
10,801,359 B2 * 10/2020 Blakeman ..... F01D 21/003
2009/0044542 A1 * 2/2009 Thatcher ..... F04D 27/001 60/773
2011/0106680 A1 5/2011 Vittal et al.
2012/0095662 A1 4/2012 Roy et al.
2013/0024179 A1 1/2013 Mazzaro et al.
2016/0047269 A1 * 2/2016 Zacchera ..... F01D 21/003 416/61

(Continued)

FOREIGN PATENT DOCUMENTS

EP 3597876 B1 * 12/2021 ..... F01D 11/20
GB 2460948 A * 12/2009 ..... F01D 11/20

*Primary Examiner* — Michael Lebentritt
(74) *Attorney, Agent, or Firm* — Dority & Manning, P.A.

(57) ABSTRACT

Clearance control schemes for controlling a clearance defined between a first component and a second component of a gas turbine engine are provided. In one aspect, an engine controller of the gas turbine engine implements a clearance control scheme, which includes receiving data indicating a clearance between the first component and the second component, the clearance being at least one of a measured clearance captured by a sensor and a predicted clearance specific to the gas turbine engine at that point in time; comparing the clearance to an allowable clearance; determining a clearance setpoint for a clearance adjustment system based on a clearance difference determined by comparing the clearance to the allowable clearance; and causing the clearance adjustment system to adjust the clearance to the allowable clearance based on the clearance setpoint.

18 Claims, 9 Drawing Sheets

(56) References Cited

U.S. PATENT DOCUMENTS

| | | | | |
|---|---|---|---|---|
| 2016/0326901 | A1 | 11/2016 | Rowe et al. | |
| 2017/0130602 | A1* | 5/2017 | Schelfaut | F01D 11/24 |
| 2017/0292399 | A1* | 10/2017 | Philbrick | F01D 5/02 |
| 2018/0258785 | A1* | 9/2018 | Schelfaut | B64D 27/10 |

* cited by examiner

CLEARANCE CONTROL FOR ENGINE PERFORMANCE RETENTION

FIELD

The present subject matter relates generally to gas turbine engines. More particularly, the present subject matter relates to clearance control techniques for gas turbine engines.

BACKGROUND

Conventionally, controlling clearances between tips of rotating turbine blades and a stationary shroud of a gas turbine engine has been conducted manually by inspection and the application of a deterioration pin in an engine controller change plug. Closing the clearances as components deteriorate over time retains engine performance and extends a Time-On-Wing (TOW) of a gas turbine engine. Setting or leaving the clearances too open may lead to less than optimal engine performance and efficiency. Accordingly, improved clearance control techniques would be a welcome addition to the art.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

DETAILED DESCRIPTION

Figure 1:
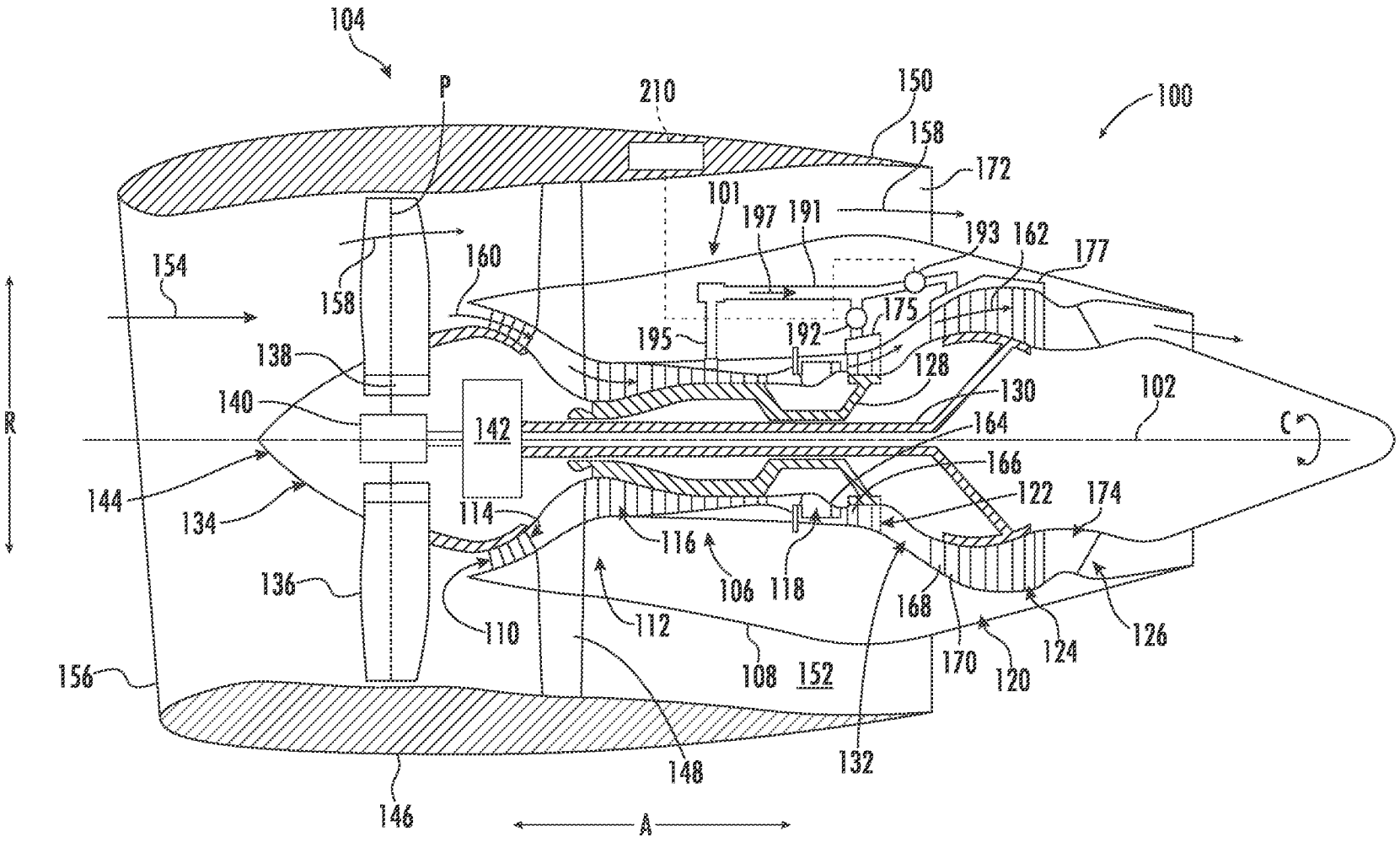
FIG. 1 provides a schematic cross-sectional view of a gas turbine engine according to an example embodiment of the present disclosure.

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

As used herein, the terms "first", "second", and "third" may be used interchangeably to distinguish one component from another and are not intended to signify location or importance of the individual components.

The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. "HP" denotes high pressure and "LP" denotes low pressure.

The terms "coupled," "fixed," "attached to," and the like refer to both direct coupling, fixing, or attaching, as well as indirect coupling, fixing, or attaching through one or more intermediate components or features, unless otherwise specified herein.

The singular forms "a", "an", and "the" include plural references unless the context clearly dictates otherwise.

The term "at least one of" in the context of, e.g., "at least one of A, B, and C" refers only A, only B, only C, or any combination of A, B, and C.

Approximating language, as used herein throughout the specification and claims, is applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 1, 2, 4, 10, 15, or 20 percent margin. These approximating margins may apply to a single value, either or both endpoints defining numerical ranges, and/or the margin for ranges between endpoints.

There is a desire for improved performance and efficiency of gas turbine engines. One way to improve or retain engine performance and efficiency is to close the clearances between components of a gas turbine engine as the engine deteriorates over time. Conventionally, controlling the clearances has been performed manually by inspection and the application of a deterioration pin in an engine controller change plug. Some engines modulate clearances dynamically based on engine operating conditions (e.g., component temperatures and rotation speeds) and thus the desired clearance changes as operating conditions change. However, engine deterioration has not been accounted for in modulating such clearances. Accordingly, improved clearance control techniques would be a welcome addition to the art.

The present disclosure is directed to dynamic clearance control schemes that retain engine performance and efficiency. In one example aspect, a gas turbine engine is provided. The gas turbine engine includes a first component and a second component rotatable relative to the first component. The first component can be a stationary component or a rotating component. The second component is rotatable, and more particularly, rotatable relative to first component.

A clearance is defined between the first component and the second component. Stated another way, the clearance is a distance between the first component and the second component. The gas turbine engine can include an engine controller having one or more processors and one or more memory devices. The one or more processors can be configured to implement a clearance control scheme. In implementing the clearance control scheme, the one or more processors are configured to receive data indicating a clearance between the first component and the second component. The clearance can be a measured clearance captured by a clearance sensor or can be a predicted clearance output by one or more models. The one or more processors can be further configured to compare the clearance to an allowable clearance. The allowable clearance can be set so as to be a minimum allowable clearance given the current operating conditions of the gas turbine engine. The allowable clearance may be a function of engine operating conditions, such as component temperatures and rotation speeds.

The one or more processors are further configured to determine a clearance setpoint for a clearance adjustment system of the gas turbine engine based at least in part on a clearance difference determined by comparing the clearance to the allowable clearance. The clearance setpoint can be dynamically adjusted based on the clearance difference or a plurality of clearance differences determined over past iterations of the clearance control scheme. Particularly, the clearance setpoint is adjusted based at least in part on one or more clearance differences, which are each determined based on a comparison of the clearance at a given point in time to an allowable clearance. The clearance, which may be a measured clearance or a predicted clearance specific to the gas turbine engine at that point in time, indicates the deterioration or health of the engine, or more specifically, the first and second components. In this regard, the clearance setpoint is dynamically adjusted based on deterioration, not just engine operating conditions.

The one or more processors can cause the clearance adjustment system to adjust the clearance to the allowable clearance based at least in part on the clearance setpoint. For instance, one or more control signals can be generated based at least in part on the clearance setpoint, and the one or more control signals can be routed to one or more controllable devices, such as control valves of an active clearance control system. The one or more controllable devices can be modulated based on the control signals to change the clearance between the first component and the second component, e.g., so that the clearance is driven to the allowable clearance. The clearance control schemes or techniques provided herein can be implemented continuously, at predetermined intervals, or upon a condition being satisfied. The clearance can be adjusted automatically, as noted above. In alternative embodiments, the clearance can be adjusted manually.

The dynamic clearance control schemes described herein may provide one or more benefits, advantages, and/or technical effects. For instance, a fuel burn benefit can be obtained by closing the clearances using the dynamic clearance control schemes provided herein. Further, a rate of change of the exhaust gas temperature of a gas turbine engine for a given set of operating conditions can be decreased using the clearance control schemes or techniques provided herein, thereby improving the TOW or service of the gas turbine engine. In addition, dynamic adjustment of the clearance setpoint based at least one of a measured clearance captured by a sensor and a predicted clearance specific to the gas turbine engine at that point in time allows the clearances to be controlled based on the unique way the engine is actually operated with a high degree of confidence that closing the clearances will not result in undesirable consequences, such as a rub event. That is, engine deterioration is accounted for in setting the clearance setpoint.

The clearance control schemes provided herein are also flexible in their application. For instance, the dynamic clearance control schemes provided herein apply to compressors, turbines, including those that are vaneless, as well as to other components that define clearances therebetween. Moreover, the clearance control schemes provided herein are agnostic with respect to how the clearances are actuated, either with changing the case diameter (thermally, mechanically, or otherwise) or the blade size (for, by example, modulating cooling flow through the turbine blades). The clearance control schemes described herein may provide other benefits, advantages, and/or technical effects than those expressly listed herein.

Referring now to the drawings, FIG. 1 provides a schematic cross-sectional view of a gas turbine engine 100 according to an example embodiment of the present disclosure. For the depicted embodiment of FIG. 1, the gas turbine engine 100 is an aeronautical, high-bypass turbofan jet engine configured to be mounted to an aircraft, e.g., in an under-wing configuration. As shown, the gas turbine engine 100 defines an axial direction A, a radial direction R, and a circumferential direction C. The axial direction A extends parallel to or coaxial with a longitudinal centerline 102 defined by the gas turbine engine 100.

The gas turbine engine 100 includes a fan section 104 and a core turbine engine 106 disposed downstream of the fan section 104. The core turbine engine 106 includes an engine cowl 108 that defines an annular inlet 110. The engine cowl 108 encases, in a serial flow relationship, a compressor section 112 including a first, booster or LP compressor 114 and a second, HP compressor 116; a combustion section 118; a turbine section 120 including a first, HP turbine 122 and a second, LP turbine 124; and an exhaust section 126. An HP shaft 128 drivingly connects the HP turbine 122 to the HP compressor 116. An LP shaft 130 drivingly connects the LP turbine 124 to the LP compressor 114. The compressor section 112, combustion section 118, turbine section 120, and exhaust section 126 together define a core air flowpath 132 through the core turbine engine 106.

The fan section 104 includes a fan 134 having a plurality of fan blades 136 coupled to a disk 138 in a circumferentially spaced apart manner. As depicted, the fan blades 136 extend outward from the disk 138 generally along the radial direction R. Each fan blade 136 is rotatable relative to the disk 138 about a pitch axis P by virtue of the fan blades 136 being operatively coupled to a suitable actuation member 140 configured to collectively vary the pitch of the fan blades 136, e.g., in unison. The fan blades 136, disk 138, and actuation member 140 are together rotatable about the longitudinal centerline 102 by the LP shaft 130 across a power gearbox 142. The power gearbox 142 includes a plurality of gears for stepping down the rotational speed of the LP shaft 130 to affect a more efficient rotational fan speed. In other embodiments, the fan blades 136, disk 138, and actuation member 140 can be directly connected to the LP shaft 130, e.g., in a direct-drive configuration. Further, in other embodiments, the fan blades 136 of the fan 134 can be fixed-pitch fan blades.

Referring still to FIG. 1, the disk 138 is covered by a rotatable spinner 144 aerodynamically contoured to promote an airflow through the plurality of fan blades 136. Additionally, the fan section 104 includes an annular fan casing or outer nacelle 146 that circumferentially surrounds the fan 134 and/or at least a portion of the core turbine engine 106. The nacelle 146 is supported relative to the core turbine engine 106 by a plurality of circumferentially-spaced outlet guide vanes 148. A downstream section 150 of the nacelle 146 extends over an outer portion of the core turbine engine 106 so as to define a bypass airflow passage 152 therebetween.

During operation of the gas turbine engine 100, a volume of air 154 enters the gas turbine engine 100 through an associated inlet 156 of the nacelle 146 and/or fan section 104. As the volume of air 154 passes across the fan blades 136, a first portion of the air 154, as indicated by arrows 158, is directed or routed into the bypass airflow passage 152 and a second portion of the air 154, as indicated by arrow 160, is directed or routed into the LP compressor 114. The pressure of the second portion of air 160 is increased as it is routed through the LP compressor 114 and the HP compressor 116. The compressed second portion of air 160 is then discharged into the combustion section 118.

The compressed second portion of air 160 from the compressor section 112 mixes with fuel and is burned within a combustor of the combustion section 118 to provide combustion gases 162. The combustion gases 162 are routed from the combustion section 118 along a hot gas path 174 of the core air flowpath 132 through the HP turbine 122 where a portion of thermal and/or kinetic energy from the combustion gases 162 is extracted via sequential stages of HP turbine stator vanes 164 and HP turbine blades 166. The HP turbine blades 166 are mechanically coupled to the HP shaft 128. Thus, when the HP turbine blades 166 extract energy from the combustion gases 162, the HP shaft 128 rotates, thereby supporting operation of the HP compressor 116. The combustion gases 162 are routed through the LP turbine 124 where a second portion of thermal and kinetic energy is extracted from the combustion gases 162 via sequential stages of LP turbine stator vanes 168 and LP turbine blades 170. The LP turbine blades 170 are coupled to the LP shaft 130. Thus, when the LP turbine blades 170 extract energy from the combustion gases 162, the LP shaft 130 rotates, thereby supporting operation of the LP compressor 114 and the fan 134.

The combustion gases 162 are subsequently routed through the exhaust section 126 of the core turbine engine 106 to provide propulsive thrust. Simultaneously, the pressure of the first portion of air 158 is substantially increased as the first portion of air 158 is routed through the bypass airflow passage 152 before it is exhausted from a fan nozzle exhaust section 172 of the gas turbine engine 100, also providing propulsive thrust. The HP turbine 122, the LP turbine 124, and the exhaust section 126 at least partially define the hot gas path 174 for routing the combustion gases 162 through the core turbine engine 106.

As further shown in FIG. 1, the gas turbine engine 100 includes a clearance adjustment system, which in this embodiment is an active clearance control (ACC) system 101. Generally, the ACC system 101 is configured to dynamically control the blade tip clearances between a rotating component, such as a turbine blade, and a stationary component, such as a shroud. For this embodiment, the ACC system 101 includes one or more compressor supply ducts, such as compressor supply duct 195, that feeds into a supply duct 191. The supply duct 191 provides a conduit for thermal control air 197 to flow from the HP compressor 116 of the compressor section 112 to the HP turbine 122 and/or the LP turbine 124 as shown. Additionally, or alternatively, although not shown in the example embodiment of FIG. 1, the supply duct 191 can be configured to deliver air from the fan section 104 and/or the LP compressor 114 to the HP turbine 122 and/or the LP turbine 124.

The mass flow and temperature of the thermal control air 197 provided to the HP turbine 122 and/or the LP turbine 124 is controlled by modulating a first control valve 192 and/or a second control valve 193. For this embodiment, the first control valve 192, when modulated, controls the bleed air from the HP compressor 116 to the HP turbine 122. The second control valve 193, when modulated, controls the bleed air from the HP compressor 116 to the LP turbine 124. The first control valve 192 and the second control valve 193, or controllable devices, are controlled by and are communicatively coupled with one or more engine controller(s). In the depicted embodiment of FIG. 1, an engine controller 210 is housed within the nacelle 146. The controller 210 can be, for example, an Electronic Engine Controller (EEC) or an Electronic Control Unit (ECU) of a Full Authority Digital Engine Control (FADEC) system. The engine controller 210 includes various components for performing various operations and functions, such as controlling clearances.

When the control valves 192, 193 are open, the relatively cool or hot thermal control air 197 flows from the HP compressor 116 to the HP turbine 122 and the LP turbine 124. When the thermal control air 197 reaches the HP turbine 122, a distribution manifold 175 associated with the HP turbine 122 distributes the thermal control air 197 about the HP turbine 122 such that the blade tip clearances can be controlled. When the thermal control air 197 reaches the LP turbine 124, a distribution manifold 177 associated with the LP turbine 124 distributes the thermal control air 197 about the LP turbine 124 such that the blade tip clearances can be controlled. When the control valves 192, 193 are closed, thermal control air 197 is prevented from flowing to the HP turbine 122 and LP turbine 124. When one of the control valves 192, 193 is opened and one is closed, thermal control air 197 is allowed to flow to the turbine associated with the open control valve while the thermal control air 197 is prevented from flowing to the turbine associated with the closed control valve.

Figure 2:
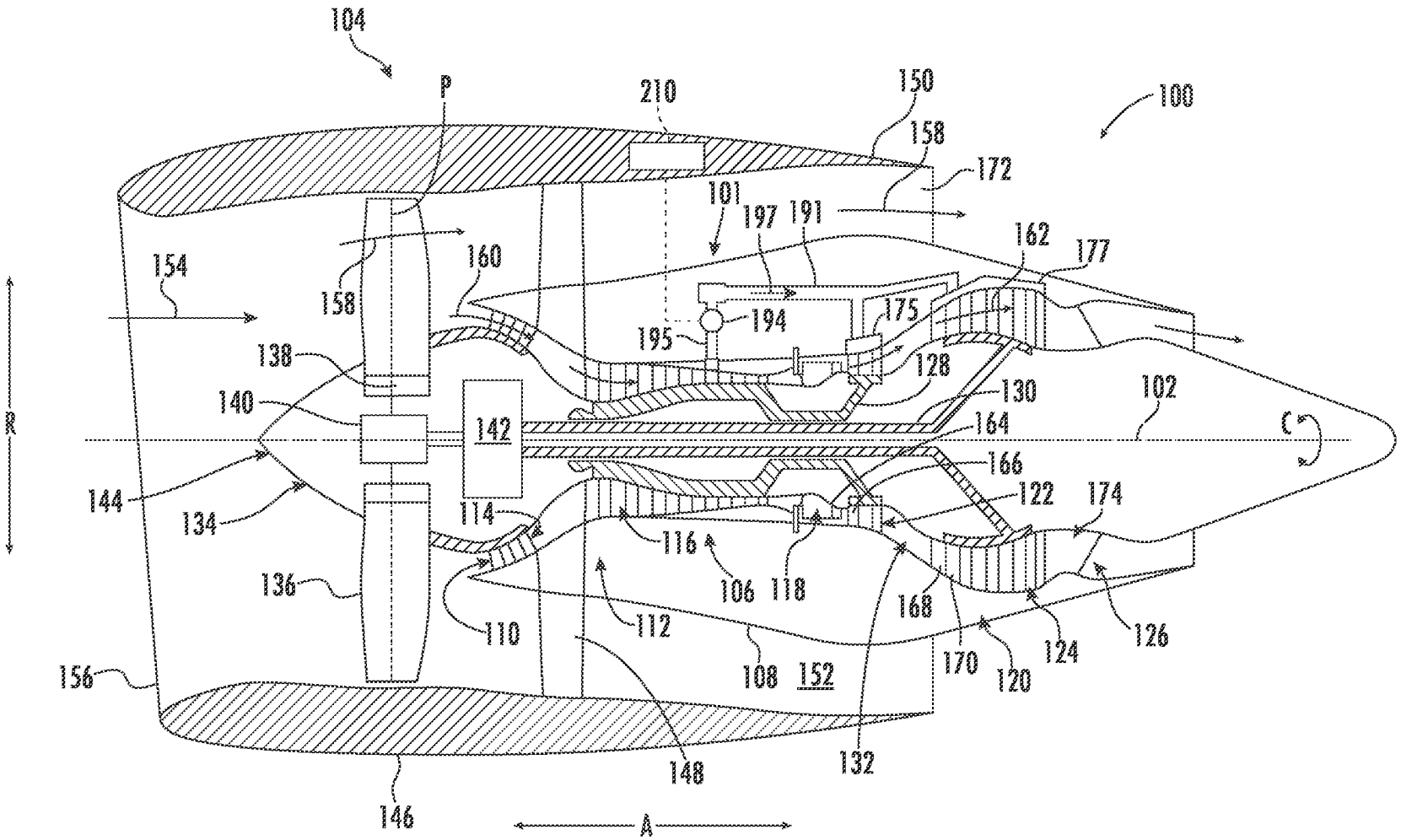
FIG. 2 provides a schematic cross-sectional view of another gas turbine engine according to an example embodiment of the present disclosure.

Although the embodiment of FIG. 1 is shown having two control valves 192, 193, it will be appreciated that any suitable number of control valves can be included. In some alternative embodiments, such as depicted in FIG. 2, the ACC system 101 can include a single control valve 194 that selectively allows thermal control air 197 to flow to the HP turbine 122 and the LP turbine 124. In other embodiments, one or more control valves can be positioned along a supply duct configured to deliver air from the fan section 104 to the HP turbine 122 and/or the LP turbine 124. Other configurations are possible.

In addition, it will be appreciated that the ACC system 101 depicted in FIG. 1 is one example clearance adjustment system. In other example embodiments, the clearance adjustment system can have other suitable configurations. For instance, in one some embodiments, the clearance adjustment system can include one or more electrical heating elements with no or fixed cooling air to modulate clearances. Other clearance adjustment systems are contemplated.

Further, it will be appreciated that the gas turbine engine 100 depicted in FIG. 1 is provided by way of example only, and that in other example embodiments, the gas turbine engine 100 may have any other suitable configuration. Additionally, or alternatively, aspects of the present disclosure may be utilized with any other suitable aeronautical gas turbine engine, such as a turboshaft engine, turboprop engine, turbojet engine, etc. Further, aspects of the present disclosure may further be utilized with any other land-based gas turbine engine, such as a power generation gas turbine engine, or any aeroderivative gas turbine engine, such as a nautical gas turbine engine.

Figure 3:
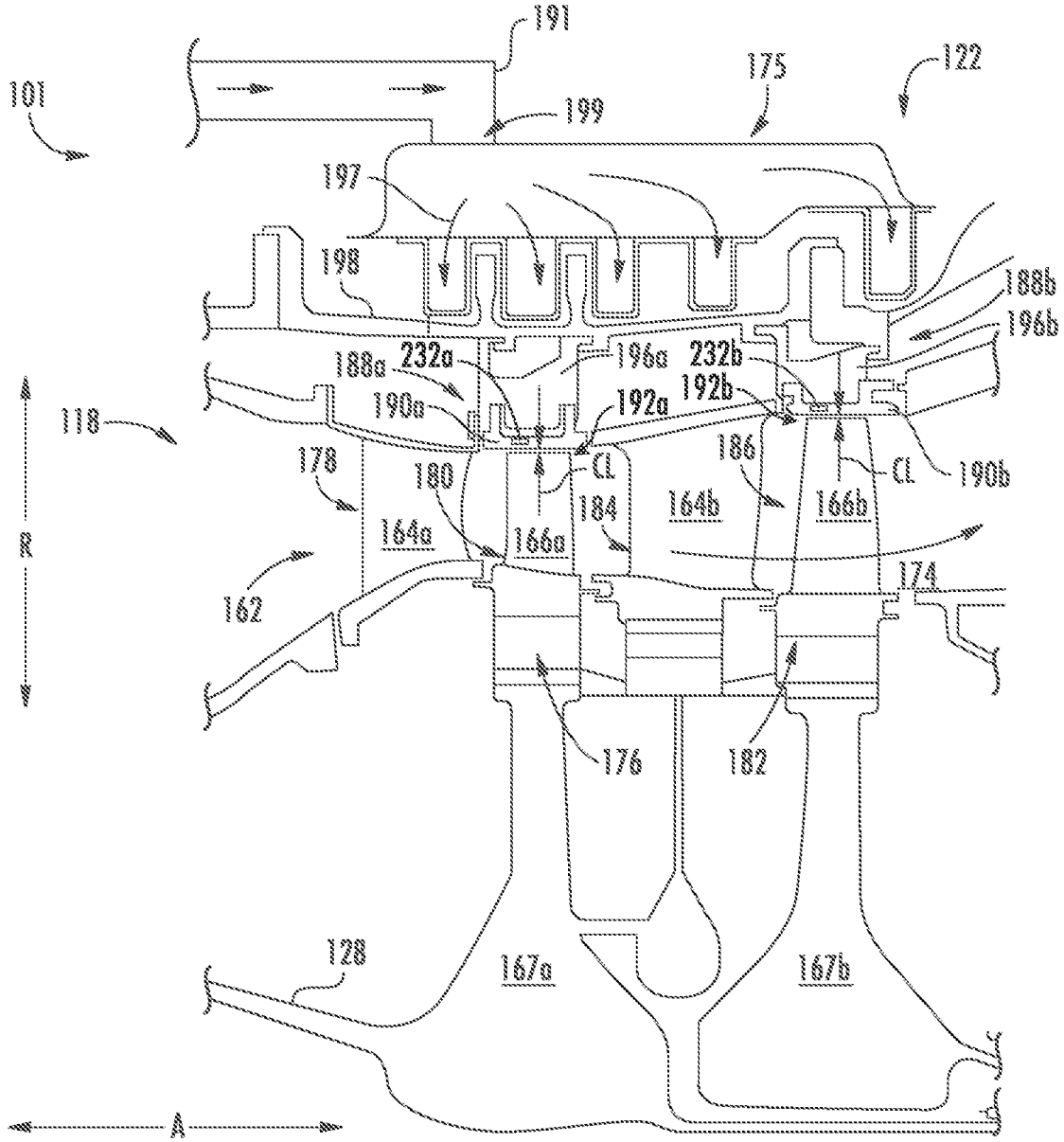
FIG. 3 provides a close-up, cross sectional view of the aft end of a combustion section and an HP turbine of the gas turbine engine of FIG. 1.

FIG. 3 provides a close-up cross sectional view of the aft end of the combustion section 118 and the HP turbine 122 of the gas turbine engine 100 of FIG. 1. As shown in the example embodiment of FIG. 3, the HP turbine 122 includes, in serial flow relationship, a first stage 176 that includes an annular array 178 of stator vanes 164*a* (only one shown) axially spaced from an annular array 180 of turbine blades 166*a* (only one shown). The HP turbine 122 further includes a second stage 182 that includes an annular array 184 of stator vanes 164*b* (only one shown) axially spaced from an annular array 186 of turbine blades 166*b* (only one shown). The turbine blades 166*a*, 166*b* extend radially from and are coupled to the HP shaft 128 by rotor disks 167*a*, 167*b*. The stator vanes 164*a*, 164*b* and the turbine blades 166*a*, 166*b* rout combustion gases 162 from the combustion section 118 through the HP turbine 122 along the hot gas path 174.

As further depicted in FIG. 3, the HP turbine 122 includes shroud assemblies 188*a*, 188*b* each forming an annular ring about an annular array of blades. Particularly, the shroud assembly 188*a* forms an annular ring around the annular array 180 of blades 166*a* of the first stage 176, and the shroud assembly 188*b* forms an annular ring around the annular array 186 of turbine blades 166*b* of the second stage 182. For this embodiment, the shroud assemblies 188*a*, 188*b* include shrouds 190*a*, 190*b* that are coupled with respective hangers 196*a*, 196*b*, which are in turn coupled with a turbine casing 198.

The shrouds 190*a*, 190*b* of the shroud assemblies 188*a*, 188*b* are radially spaced from blade tips 192*a*, 192*b* of turbine blades 166*a*, 166*b*. A blade tip clearance CL is defined between the blade tips 192*a*, 192*b* and the shrouds 190*a*, 190*b*. It should be noted that the blade tip clearances CL may similarly exist in the LP compressor 114, HP compressor 116, and/or LP turbine 124. Accordingly, the present subject matter disclosed herein is not limited to adjusting blade tip clearances and/or clearance closures in HP turbines; rather, the teachings of the present disclosure may be utilized to adjust blade tip clearances in any suitable section of the gas turbine engine 100.

As noted previously, the ACC system 101 modulates a flow of relatively cool or hot thermal control air 197 from the fan section 104 and/or compressor section 112 and disperses the air on the HP and/or LP turbine casing (e.g., the turbine casing 198 of the HP turbine 122) to shrink or expand the turbine casings relative to the HP/LP turbine blade tips depending on the operational and flight conditions of the aircraft and engine, among other factors. As shown in FIG. 3, the thermal control air 197 is routed to the HP turbine 122 via the supply duct 191. In some implementations, thermal control air 197 can be routed through a heat exchanger (not shown) for further cooling or warming of the air. The thermal control air 197 enters the distribution manifold 175 through an inlet 199 defined by the distribution manifold 175. The thermal control air 197 is distributed via the distribution manifold 175 over the turbine casing 198. In this way, the blade tip clearances CL can be controlled. The amount of thermal control air 197 provided to the HP turbine 122 (and/or LP turbine 124) can be controlled by modulating the control valves 192, 193 (FIG. 1) as explained above.

It will be appreciated that engine performance is dependent at least in part on the blade tip clearances CL between the turbine blade tips and shrouds. Generally, the tighter the clearance between the blade tips and shrouds (i.e., the more closed the clearances), the more efficient the gas turbine engine can be operated. Thus, minimizing or otherwise reducing the blade tip clearances CL facilitates optimal and/or otherwise improved engine performance and efficiency. A challenge in minimizing the blade tip clearances CL, however, is that the turbine blades expand and contract at different rates than the shrouds and casings circumferentially surrounding them.

More particularly, the blade tip clearances CL between turbine blade tips and the surrounding shrouds and turbine casings may be impacted by two main types of loads: power-induced engine loads and flight loads. Power-induced engine loads generally include centrifugal, thermal, internal pressure, and thrust loads. Flight loads generally include inertial, aerodynamic, and gyroscopic loads. Centrifugal and thermal engine loads are responsible for the largest radial variation in blade tip clearances CL. With regard to centrifugal loads, the blades of turbine engines may mechanically expand or contract depending on their rotational speed. Generally, the faster the rotational speed of the rotor, the greater the mechanical expansion of the turbine blades and thus the further radially outward the blades extend. Conversely, the slower the rotational speed of the rotor, the less mechanical expansion the rotor experiences and the further radially inward the blades extend from the centerline longitudinal axis of the engine. With regard to thermal loads, as the engine heats up or cools down due at least in part to power level changes (i.e., changes in engine speed), the rotor and casings thermally expand and/or contract at differing rates. That is, the rotor is relatively large and heavy, and thus the thermal mass of the rotor heats up and cools down at a much slower rate than does the relatively thin and light turbine casings. Thus, the thermal mass of the casings heats up and cools off much faster than the rotor.

Accordingly, as an aircraft maneuvers and its engines perform various power level changes, the rotor and casings contract and expand at different rates. As such, the rotor and casings are sometimes not thermally matched. This mismatch leads to changes in the blade tip clearances CL, and in some cases, the turbomachinery components may come into contact with or rub one another, causing a rub event. For example, a rub event may occur where a blade tip 192*a*, 192*b* comes into contact with or touches a corresponding shroud 190*a*, 190*b*. Rub events may cause poor engine performance and efficiency, may reduce the effective service lives of the turbine blades 166*a*, 166*b* and/or the shrouds 190*a*, 190*b*, and may deteriorate the exhaust gas temperature margin of the engine. Thus, ideally, the blade tip clearances CL are set so as to minimize the clearance between the blade tips and the shrouds without the turbomachinery components experiencing rub events. Taking these aspects into consideration, control techniques for setting clearances are provided herein.

Figure 4:
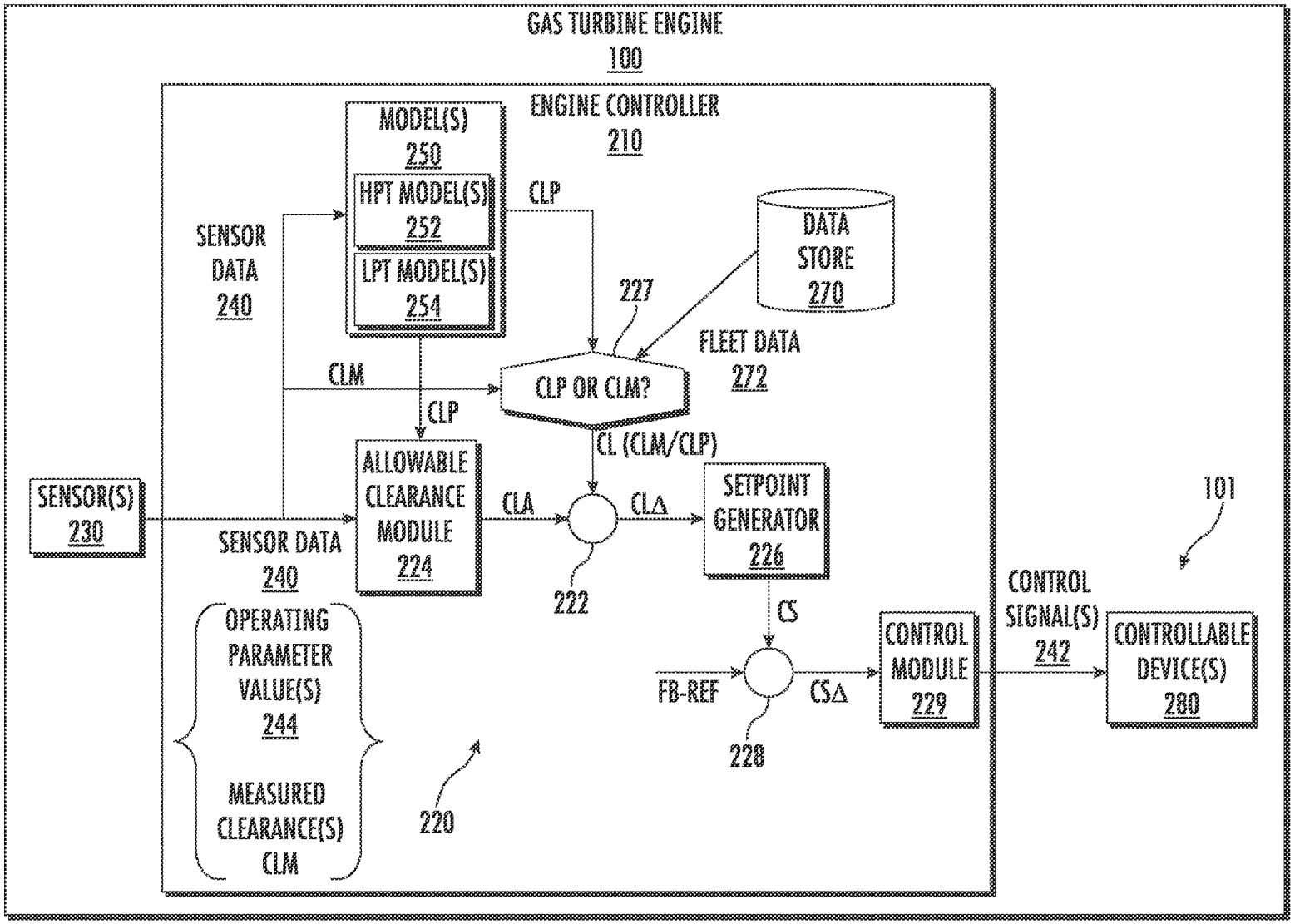
FIG. 4 provides a data flow diagram for implementing a clearance control technique according to an example embodiment of the present disclosure.

With reference now to FIGS. 1, 3, and 4, FIG. 4 provides a data flow diagram for implementing a clearance control scheme for the gas turbine engine 100 of FIG. 1. Although the clearance control scheme is described below as being implemented to control the clearances of the gas turbine engine 100 of FIG. 1, it will be appreciated that the clearance control scheme provided below may be implemented to control the clearances of other gas turbine engines having other configurations.

As shown in FIG. 4, the gas turbine engine 100 includes one or more sensors 230 operable to capture values for various operating parameters and/or conditions associated with the gas turbine engine 100. The captured values, or sensor data 240, can be routed to the engine controller 210. The one or more sensors 230 can continuously capture operating parameter values, may do so at predetermined intervals, and/or upon a condition being satisfied.

In some embodiments, the one or more sensors 230 can include at least one sensor operable to directly measure the clearance between a rotating component and a stationary component of the gas turbine engine 100. For instance, the one or more sensors 230 can include a sensor 232*a* (FIG. 3) operable to measure the clearance between the turbine blade 166*a* and the shroud 190*a*. The one or more sensors 230 can also include a sensor 232*b* (FIG. 3) operable to measure the clearance between the turbine blade 166*b* and the shroud 190*b*. The sensors 232*a*, 232*b* can be optical probes, inductive proximity sensors, a combination thereof, or any suitable type of sensors operable to directly measure the clearance between their respective rotating and stationary components. The sensors 232*a*, 232*b* can each capture an instantaneous clearance between their respective turbine blades 166*a*, 166*b* and shrouds 190*a*, 190*b* and may provide the instantaneous clearances, or measured clearances CLM (s), to the engine controller 210 as part of the sensor data 240.

The one or more sensors 230 can also include at least one sensor operable to directly measure the clearance between a rotating component and a stationary component of the LP turbine 124. The sensor positioned in the LP turbine 124 can capture an instantaneous clearance between an LP turbine blade 170 (or an array of LP turbine blades) and its associated shroud and may provide the instantaneous clearance, or measured clearance CLM, to the engine controller 210 as part of the sensor data 240.

The one or more sensors 230 can also include other sensors as well. The one or more sensors 230 can include sensors operable to capture or measure operating parameter values 244 for various operating parameters, such as various speeds, pressures, temperatures, etc. that indicate the operating conditions or operating point of the gas turbine engine 100. Example operating parameters include, without limitation, a shaft speed of the LP shaft 130, a shaft speed of the HP shaft 128, a compressor discharge pressure, an ambient temperature, an ambient pressure, a temperature along the hot gas path 174 between the HP turbine 122 and the LP turbine 124, an altitude at which the gas turbine engine 100 is operating, etc. Such sensors can measure or capture the operating parameter values 244 for their respective operating parameters and such operating parameter values 244 can be routed to the engine controller 210 as part of the sensor data 240 as depicted in FIG. 4. The sensor data 240 can also include data indicating a power level of the gas turbine engine 100, e.g., based on a position of a throttle of the gas turbine engine 100.

The engine controller 210 includes a clearance control module 220. The clearance control module 220 can be a set of computer-executable instructions or logic that, when executed by one or more processors of the engine controller 210, cause the one or more processors to implement a clearance control scheme. In implementing the clearance control scheme, the one or more processors can cause a clearance adjustment system, such as the active clearance control system 101 of FIG. 1, to adjust of a clearance between a rotating component and a stationary component of the gas turbine engine 100. For instance, implementation of a clearance control scheme can cause the clearance between a rotating component and a stationary component of the gas turbine engine 100 to be set more closed.

One or more processors of the engine controller 210 can execute the clearance control module 220 to implement a first clearance control scheme. In implementing the first clearance control scheme by executing the clearance control module 220, the one or more processors of the engine controller 210 can receive data indicating a clearance CL between a rotating component and a stationary component of the gas turbine engine 100. The clearance CL can be a measured clearance CLM received as part of the sensor data 240. The measured clearance CLM, as noted above, can be captured by a sensor positioned proximate the clearance CL, such as sensor 232*a* or sensor 232*b* of FIG. 3.

The one or more processors, in executing the clearance control module 220, can compare the clearance CL, or measured clearance CLM in this example first clearance control scheme, to an allowable clearance CLA. For instance, the measured clearance CLM can be compared to the allowable clearance CLA at block 222. The allowable clearance CLA can be a minimum allowable clearance given the operating conditions of the gas turbine engine 100, for example. The allowable clearance CLA can be output by an allowable clearance module 224 based at least in part on the sensor data 240. Particularly, the allowable clearance CLA can be determined based at least in part on the operating parameter values 244 received as part of the sensor data 240. The one or more processors of the engine controller 210 can execute the allowable clearance module 2224 to process the operating parameter values 244 to determine the operating conditions or operating point of the gas turbine engine 100. Then, the one or more processors of the engine controller 210 can determine the allowable clearance CLA for the given operating conditions of the gas turbine engine 100. The operating conditions can include, among other things, the power level of the gas turbine engine 100, the rate of change of the power level, the altitude, and other conditions relating to the core of the gas turbine engine 100, such as temperatures and pressures at certain engine stations of the gas turbine engine 100. In this regard, the allowable clearance CLA can be determined based at least in part on operating conditions associated with the gas turbine engine 100.

The power level may impact the determination of the allowable clearance CLA in that the power level correlates with the rotational speed of various rotating components of the gas turbine engine 100, such as the LP shaft 130. The rotational speeds of the rotating components impact the allowable clearance CLA. The power level also correlates with temperatures at certain engine stations of the gas turbine engine 100, such as the inter-turbine inlet temperature, or T45. The temperatures at certain engine stations impact the allowable clearance CLA. The rate of power level change may impact the determination of the allowable clearance CLA in that the greater the rate of change of the power level, particularly during power level increases, the more open the allowable clearance CLA is typically set to allow for thermal growth of the components. In contrast, for lesser rates of change, the allowable clearance CLA may be set more closed. The altitude may impact the allowable clearance CLA as well. For instance, at lower altitudes, the allowable clearance CLA may be set more open to allow for rapid thermal growth, e.g., during takeoff and climb phases of flight. In contrast, at higher altitudes corresponding to cruise operations, the allowable clearance CLA may be set more closed as the power level of the gas turbine engine 100 typically remains more steady during such cruise operations.

A clearance difference CLΔ can be determined by comparing the clearance CL, which is the measured clearance CLM in this first clearance control scheme, to the allowable clearance CLA at block 222. For example, the clearance difference CLΔ can be determined by subtracting the allowable clearance CLA from the clearance CL.

The one or more processors of the engine controller 210, in executing the clearance control module 220, can determine a clearance setpoint CS for the clearance adjustment system based at least in part on the clearance difference CLΔ determined by comparing the clearance CL to the allowable clearance CLA at block 222. For instance, the clearance difference CLΔ can be routed to a setpoint generator 226. The setpoint generator 226 can output the clearance setpoint CS based at least in part on the clearance difference CLΔ. For example, the setpoint generator 226 can correlate the clearance difference CLΔ to a clearance setpoint CS, e.g., using a look-up table.

In some embodiments, the determined clearance setpoint CS can be adjusted from a nominal clearance setpoint or past clearance setpoint when the clearance difference CLΔ satisfies a threshold. In such embodiments, the one or more processors of the engine controller 210 can determine whether the clearance difference CLΔ satisfies a threshold. When the clearance difference CLΔ satisfies the threshold, the clearance setpoint CS for the clearance adjustment system is determined as being different than a past clearance setpoint, wherein the past clearance setpoint is determined based at least in part on a past clearance difference determined by comparing a past clearance to the allowable clearance CLA. Further, the one or more processors of the engine controller 210, in executing the clearance control module 220, can cause the clearance adjustment system to adjust the clearance CL to the allowable clearance CLA based at least in part on the clearance setpoint CS.

Figure 5:
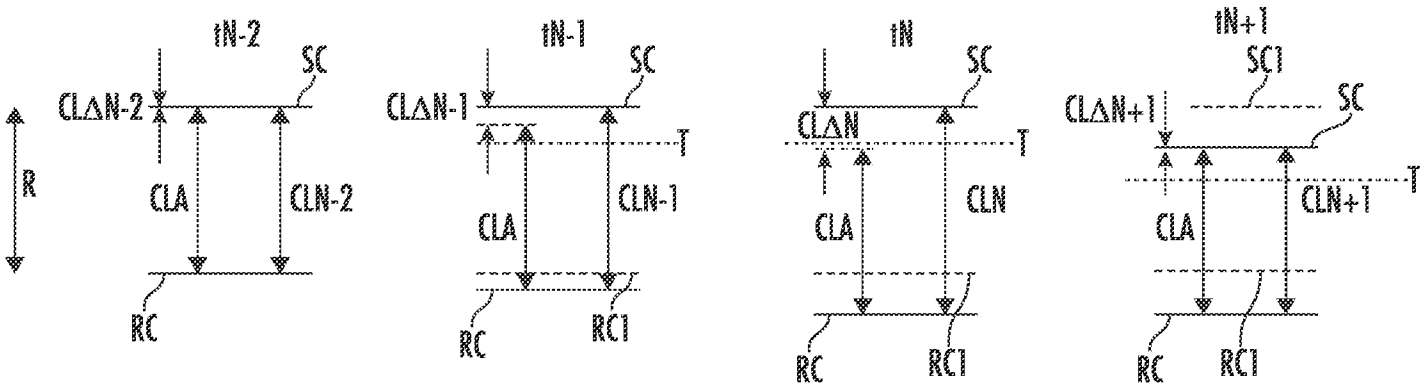
FIG. 5 provides a series of schematic diagrams depicting how a clearance between a rotating component and stationary component can be controlled according to an example clearance control scheme of the present disclosure.

For example, with reference to FIG. 5, at time tN−2, wherein N is the iteration of the first clearance control scheme, the clearance difference CLΔN−2 is zero or negligible as the allowable clearance CLA is equal or about equal to the clearance CLN−2. At time tN−1, the clearance difference CLΔN−1 is no longer zero, e.g., due to deterioration of the rotating component RC. Indeed, the rotating component RC has deteriorated such that the tip of the rotating component RC has moved radially inward from its first position RC1 to its current position at time tN−1. The clearance CLN−1 measured at time tN−1 is greater than the allowable clearance CLA. Notably, however, the clearance difference CLΔN−1 does not satisfy the threshold T. That is, the radially inward bound of the clearance difference CLΔN−2 is positioned inward of the threshold T along the radial direction R. The threshold T can span a predetermined distance radially inward from the stationary component SC. Alternatively, the threshold can span a predetermined distance radially outward from a hub (not shown in FIG. 5) of the rotating component RC.

At time tN, the present iteration of the first clearance control scheme, the clearance difference CLΔN has become larger than the clearance difference CLΔN−1 measured at time tN, e.g., due to further deterioration of the rotating component RC. As depicted, the clearance difference CLΔN satisfies the threshold T. That is, the radially inward bound of the clearance difference CLΔN is positioned inward of the threshold T along the radial direction R. Accordingly, the clearance setpoint CS (FIG. 4) is adjusted or determined as being different than a past clearance setpoint determined based at least in part on a past clearance difference (e.g., CLΔN−2, CLΔN−1) determined by comparing a past clearance (CLN−2, CLN−1) to the allowable clearance CLA. Stated another way, the clearance setpoint CS for a given set of operating conditions is adjusted relative to a past clearance setpoint used to control the clearance for the given set of operating conditions.

The clearances CLN−2, CLN−1, and CLN indicate the health of the rotating and/or stationary components RC, SC, and when compared with the allowable clearance CLA that is selected for a given set of operating conditions, the clearance differences CLΔN−2, CLΔN−1, CLΔN are rendered. Comparing the clearance differences CLΔN−2, CLΔN−1, CLΔN to the threshold T provides a degree of confidence that, when a clearance difference satisfies the threshold T, the clearance setpoint CS can be adjusted for the given operating conditions/allowable clearance so as not tighten the clearances prematurely. The adjustment of the clearance setpoint CS may help to avoid rub events. When a clearance satisfies the threshold T, the clearance setpoint CS can be selected so that the clearance adjustment system can adjust the clearance CL to the allowable clearance CLA. For instance, as shown at time tN+1, a next iteration of the first clearance control scheme, the clearance setpoint CS for the clearance adjustment system can be determined so that the clearance CLN+1 can be adjusted to the allowable clearance CLA. By adjusting the clearance setpoint CS, the clearance adjustment system can tighten the clearance by moving the stationary component SC from its previous position SC1 radially inward toward the rotating component RC to its new position, denoted by SC at time tN+1. As a result, the clearance difference CLΔN+1 is zero or negligible once again despite system deterioration. The threshold T can then be readjusted as depicted in FIG. 5 at time tN+1.

In some other embodiments, the determined clearance setpoint CS can be adjusted from a nominal clearance setpoint or past clearance setpoint based at least in part on a plurality of clearance differences. Each one of the plurality of clearance differences can be determined by comparing the clearance at that point in time with the allowable clearance CLA. In such embodiments, the one or more processors of the engine controller 210 can determine whether a predetermined number of clearance differences of the plurality of clearance differences satisfy a threshold. When the predetermined number of clearance differences of the plurality of clearance differences satisfy the threshold, the clearance setpoint for the clearance adjustment system is determined as being different than a past clearance setpoint determined based at least in part on a past clearance difference determined by comparing a past clearance to the allowable clearance.

Figure 6:
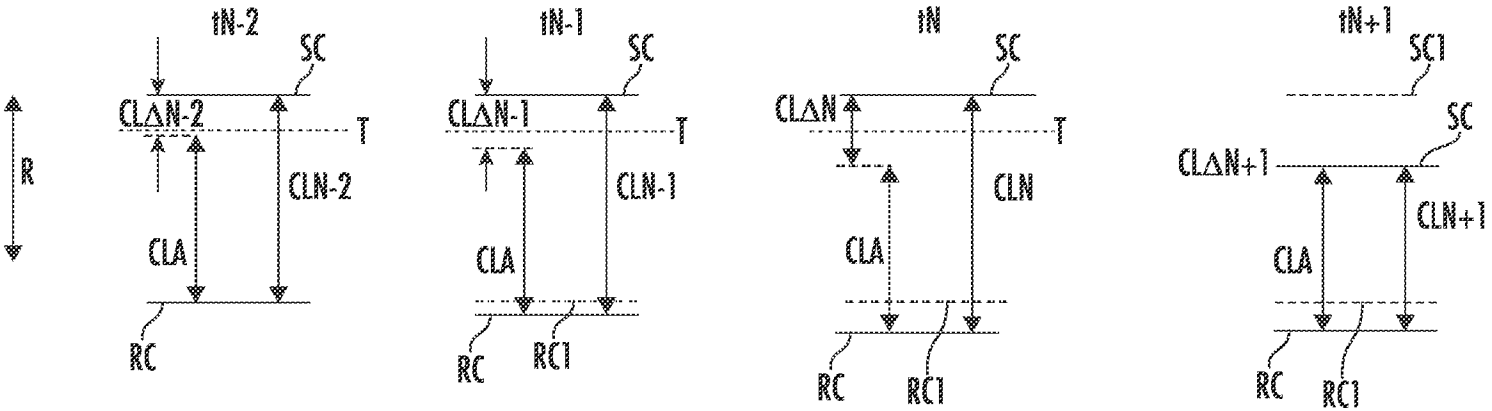
FIG. 6 provides a series of schematic diagrams depicting how a clearance between a rotating component and stationary component can be controlled according to another example clearance control scheme of the present disclosure.

By way of example, the predetermined number of clearance differences can be set at three, for example. The predetermined number of clearance differences can be set at other numbers as well. With reference to FIG. 6, at time tN−2, wherein N is the iteration of the first clearance control scheme, the clearance difference CLΔN−2 satisfies the threshold T. That is, the radially inward bound of the clearance difference CLΔN−2 is positioned inward of the threshold T along the radial direction R. Thus, at time tN−2, a first clearance difference satisfies the threshold T.

At time tN−1, the clearance difference CLΔN−1 satisfies the threshold T. That is, the radially inward bound of the clearance difference CLΔN−1 is positioned inward of the threshold T along the radial direction R. Thus, at time tN−1, a second clearance difference satisfies the threshold T. At time tN, the present time, the clearance difference CLΔN satisfies the threshold T as the radially inward bound of the clearance difference CLΔN is positioned inward of the threshold T along the radial direction R. Thus, at time tN, a third clearance difference satisfies the threshold T. As the clearance difference CLΔN−2, the clearance difference CLΔN−1, and the clearance difference CLΔN each satisfied the threshold T, the predetermined number of clearance differences that satisfy the threshold T has been reached. Accordingly, the clearance setpoint CS (FIG. 4) can be determined as being different than a past clearance setpoint determined based at least in part on a past clearance difference (e.g., CLΔN−2, CLΔN−1) determined by comparing a past clearance (CLN−2, CLN−1) to the allowable clearance CLA. Stated differently, the clearance setpoint CS for the given set of operating conditions is adjusted relative to a past clearance setpoint used to control the clearance for the given set of operating conditions. By adjusting the clearance setpoint after a predetermined number of clearance differences satisfy the threshold, there may be improved confidence in closing the clearances. That is, there may be improved confidence in closing the clearances after a predetermined number of instances occur in which the determined clearance difference satisfies the threshold. Ensuring that multiple determined clearance differences satisfy the threshold provides increased confidence that the rotating component RC will not rub the stationary component SC when the clearances are moved more closed. Thus, performance retention may be achieved with confidence.

In some other embodiments, the determined clearance setpoint CS can be adjusted from a nominal clearance setpoint or past clearance setpoint when a predetermined number of clearance differences satisfy a threshold for a predetermined number of consecutive iterations of the clearance control scheme.

By way of example, the predetermined number of clearance differences can be set at three (3) and the predetermined number of consecutive iterations can be set at three (3) as well. Other suitable predetermined numbers can be selected as well. With reference to FIG. 6, at time tN−2, wherein N is the iteration of the first clearance control scheme, the clearance difference CLΔN−2 satisfies the threshold T. Thus, at time tN−2, a first clearance difference satisfies the threshold T. At time tN−1, the clearance difference CLΔN−1 satisfies the threshold T. Thus, at time tN−1, a second clearance difference satisfies the threshold T, and as the iteration at time tN−2 and the iteration at time tN−1 are consecutive iterations, the clearance difference has satisfied the threshold for consecutive iterations. At time tN, the present time and iteration, the clearance difference CLΔN satisfies the threshold T. Thus, at time tN, a third clearance difference satisfies the threshold T, and as the iteration at time tN−2, the iteration at time tN−1, and the iteration at time tN are consecutive iterations, the clearance difference has satisfied the threshold for three consecutive iterations of the clearance control scheme.

In this regard, the determined clearance setpoint CS can be adjusted from a nominal clearance setpoint or past clearance setpoint as the predetermined number of clearance differences satisfied the threshold T for a predetermined number of consecutive iterations. Ensuring that the clearance difference satisfies the threshold T for a predetermined number of consecutive iterations instills further confidence that the clearance can be moved more closed for the given operating conditions without a high likelihood that the rotating component RC will rub the stationary component SC. When a given clearance difference does not satisfy the threshold T, as will be appreciated based on the teachings herein, the predetermined number of consecutive iterations resets and the clearance control scheme continues to iterate.

With reference again to FIGS. 1, 3, and 4, as noted above, the one or more processors of the engine controller 210, in executing the clearance control module 220, can cause the clearance adjustment system to adjust the clearance CL between the rotating component and the stationary component of the gas turbine engine 100 to the allowable clearance CLA based at least in part on the clearance setpoint CS. Particularly, as shown in FIG. 4, the clearance setpoint CS can be compared to a feedback reference FB-REF at block 228. For instance, in some embodiments, the clearance setpoint CS can indicate a target position of a control valve and the feedback reference FB-REF can indicate an actual position of the control valve. The actual position can be measured or predicted. A clearance setpoint difference CSA can be determined based on comparing the clearance setpoint CS to the feedback reference FB-REF. The clearance setpoint difference CSA can be input into a control module 229 and one or more control signals 242 can be generated based at least in part on the clearance setpoint difference CSA. Based at least in part on the one or more control signals 242, one or more controllable devices 280 of clearance adjustment system can adjust the clearance CL to effect the allowable clearance CLA.

As one example, the one or more controllable devices 280 can include the first control valve 192 of FIG. 1. The one or more control signals 242 can be routed to the first control valve 192, and based on the one or more control signals 242, the first control valve 192 can be modulated to change the mass flow of the thermal control air 197 (FIG. 3) provided to the HP turbine 122, which ultimately adjusts the clearance CL between the rotating and stationary components of the HP turbine 122.

The first control scheme can be iterated continuously, at predetermined intervals (e.g., upon every start-up of the gas turbine engine 100, every week, every month, etc.), and/or when a condition is satisfied (e.g., when the exhaust gas temperature reaches a threshold, when the gas turbine engine 100 has reached a predetermined number of missions, etc.). Moreover, although the ACC system 101 of FIG. 1 was shown and described as one example clearance adjustment system operable to adjust the clearances, the clearances can be adjusted by other suitable systems or methods. For instance, the first control scheme can be implemented and the clearances can be adjusted by a system that provides cooling air through the rotating component.

Further, it will be appreciated that the first control scheme can be implemented to adjust more than one clearance of the gas turbine engine 100. For instance, a series of measured clearances from different stages of the HP turbine 122 and/or LP turbine 124 can be compared to allowable clearances specific to those stages. The clearances of the HP turbine 122 can be adjusted based on the comparisons associated with the HP turbine 122 and the clearances of the LP turbine 124 can be adjusted based on the comparisons associated with the LP turbine 124. The first control valve 192 can be modulated based at least in part on the comparisons associated with the HP turbine 122 and the second control valve 193 can be modulated based at least in part on the comparisons associated with the LP turbine 124. In embodiments that include a single control valve 194 for controlling the thermal control air 197 to the HP turbine 122 and the LP turbine 124, such as is depicted in FIG. 2, a critical clearance can be determined from the measured clearances, and the single control valve 194 can be modulated based at least in part on the clearance difference between the critical clearance and the allowable clearance. The critical clearance can correspond to a smallest allowable minimum clearance of the HP turbine 122 and LP turbine 124.

One or more processors of the engine controller 210 can execute the clearance control module 220 to implement a second clearance control scheme. Implementation of the second clearance control scheme is similar to implementation of the first clearance control scheme except as provided below.

In implementing the second clearance control scheme by executing the clearance control module 220, one or more processors of the engine controller 210 can receive data indicating a clearance CL between a rotating component and a stationary component of the gas turbine engine 100. In the second clearance control scheme, the clearance CL is a predicted clearance CLP specific to the gas turbine engine 100 at that point in time. As shown in FIG. 4, the engine controller 210 can include or be associated with one or more models 250 operable to output one or more predicted clearances CLP(s).

The one or models 250 can include one or more physics-based models (e.g., one or more cycle models), one or more machine-learned models (e.g., one or more of an artificial neural network, a linear discriminant analysis model, a partial least squares discriminant analysis model, a support vector machine model, a random tree model, a logistic regression model, a naïve Bayes model, a K-nearest neighbor model, a quadratic discriminant analysis model, an anomaly detection model, a boosted and bagged decision tree model, a C4.5 model, a k-means model, or a combination of one or more of the foregoing), one or more statistical models, a combination thereof, etc. The one or more machine-learned models can be trained using various training or learning techniques, such as, for example, backwards propagation of errors. In some implementations, supervised training techniques can be used on a set of labeled training data. In some implementations, performing backwards propagation of errors can include performing truncated backpropagation through time. A model trainer can perform a number of generalization techniques (e.g., weight decays, dropouts, etc.) to improve the generalization capability of the model being trained. The training data can be obtained from past missions performed by the gas turbine engine 100 as well as other engines of a fleet of engines.

The one or models 250 can receive sensor data 240 as inputs, and based at least in part on the inputs, the one or more models 250 can output the one or more predicted clearances CLP(s). For instance, the sensor data 240 can include the operating parameter values 244 for various operating parameters, as noted previously. The operating parameter values 244 can include various speeds, pressures, and/or temperatures, etc. associated with the gas turbine engine 100. These speeds, pressures, temperatures, etc. can be used to determined various calculated parameter values for various calculated operating parameters, such as various flows, efficiencies, exhaust gas temperature, etc. The sensed and/or calculated parameter values can be input into the one or more models 250, and the one or models 250 can output the one or more predicted clearances CLP(s) based at least in part on the sensed and/or calculated parameter values.

The one or more processors of the engine controller 210, in executing the clearance control module 220, can compare the clearance CL, or predicted clearance CLP in this example second clearance control scheme, to the allowable clearance CL. The one or more processors of the engine controller 210, in executing the clearance control module 220, can then determine a clearance setpoint CS for the clearance adjustment system based at least in part on a clearance difference CLΔ determined by comparing the clearance CL, or predicted clearance CLP in the second clearance control scheme, to the allowable clearance CLA. Further, the one or more processors of the engine controller 210, in executing the clearance control module 220, can then cause the clearance adjustment system to adjust the clearance CL to the allowable clearance CLA based at least in part on the clearance setpoint CS as described above.

Like the first control scheme, the second control scheme can be iterated continuously, at predetermined intervals (e.g., upon every start-up of the gas turbine engine 100, every week, every month, etc.), or when a condition is satisfied (e.g., when the exhaust gas temperature reaches a threshold, when the gas turbine engine 100 has reached a predetermined number of missions, etc.). In addition, the clearances can be adjusted by any suitable systems or methods, such as by the ACC system 101 or by providing cooling air through the rotating component.

It will be appreciated that the second control scheme can be implemented to adjust more than one clearance of the gas turbine engine 100. For instance, one or more predicted clearances CLP(s) associated with the HP turbine 122 can be output by one or HPT models 252 of the one or models 250 and one or more predicted clearances CLP(s) associated with the LP turbine 124 can be output by one or LPT models 254 of the one or models 250. The predicted clearances CLP(s) associated with the HP turbine 122 can be compared to allowable clearances specific to the HP turbine 122 and the predicted clearances CLP(s) associated with the LP turbine 124 can be compared to allowable clearances specific to the LP turbine 124. The clearances of the HP turbine 122 can be adjusted based on the comparisons between the predicted clearances CLP(s) associated with the HP turbine 122 and the allowable clearances associated with the HP turbine 122, and the clearances of the LP turbine 124 can be adjusted based on the comparisons between the predicted clearances CLP(s) associated with the LP turbine 124 and the allowable clearances associated with the LP turbine 124, e.g., by modulating the first control valve 192 and the second control valve 193. In embodiments that include a single control valve 194 for controlling the thermal control air 197 to the HP turbine 122 and the LP turbine 124, as provided in FIG. 2, a critical clearance can be determined from the predicted clearances, and the single control valve 194 can be modulated based at least in part on a comparison between the critical clearance and its corresponding allowable clearance. The critical clearance can correspond to a smallest allowable minimum clearance of the HP turbine 122 and LP turbine 124, for example.

Although not shown, the one or more models 250 can include other models specific to certain components or stages of components than the HPT models 252 and LPT models 254 shown in FIG. 4. For instance, in some embodiments, the one or more models 250 can include one or more HPC models associated with the HP compressor 116, including, for example, one or more models associated with the overall HP compressor 116 and one or more models specific to certain stages of the HP compressor 116. In other embodiments, the one or models 250 can include one or more LPC models associated with the LP compressor 114, including, for example, one or more models associated with the overall LP compressor 114 and one or more models specific to certain stages of the LP compressor 114.

One or more processors of the engine controller 210 can execute the clearance control module 220 to implement a third clearance control scheme. In implementing the third clearance control scheme, both a measured clearance CLM and predicted clearance CLP are considered, and confidence scores are determined for the measured clearance CLM and the predicted clearance CLP. The clearance in which the most confidence is placed is selected as the clearance that is compared to the allowable clearance CLA. That is, the clearance with the higher confidence score is selected as the clearance that is compared to the allowable clearance CLA. The one or more processors of the engine controller 210, in executing the clearance control module 220, can determine a clearance setpoint for the clearance adjustment system based at least in part on a clearance difference CLΔ determined by comparing the selected clearance to the allowable clearance CLA. Further, the one or more processors of the engine controller 210, in executing the clearance control module 220, can then cause the clearance adjustment system to adjust the clearance CL between the rotating component and the stationary component of the gas turbine engine 100 based at least in part on the clearance setpoint CS.

More particularly, in implementing the third clearance control scheme by executing the clearance control module 220, one or more processors of the engine controller 210 can receive data indicating a clearance CL between a rotating component and a stationary component of the gas turbine engine 100. The data can indicate a measured clearance CLM received as part of the sensor data 240 as well as a predicted clearance CLP output by the one or more models 250. At block 227, the one or more processors of the engine controller 210 can determine whether to use the measured clearance CLM or the predicted clearance CLP based on their respective confidence scores. Thus, at block 227, the one or more processors of the engine controller 210 can generate a confidence score for the measured clearance CLM and can generate a confidence score for the predicted clearance CLP. The clearance with the higher confidence score can be selected as the clearance CL for comparison against the allowable clearance CLA. In the first and second control schemes, block 227 can be optionally removed.

Figure 7:
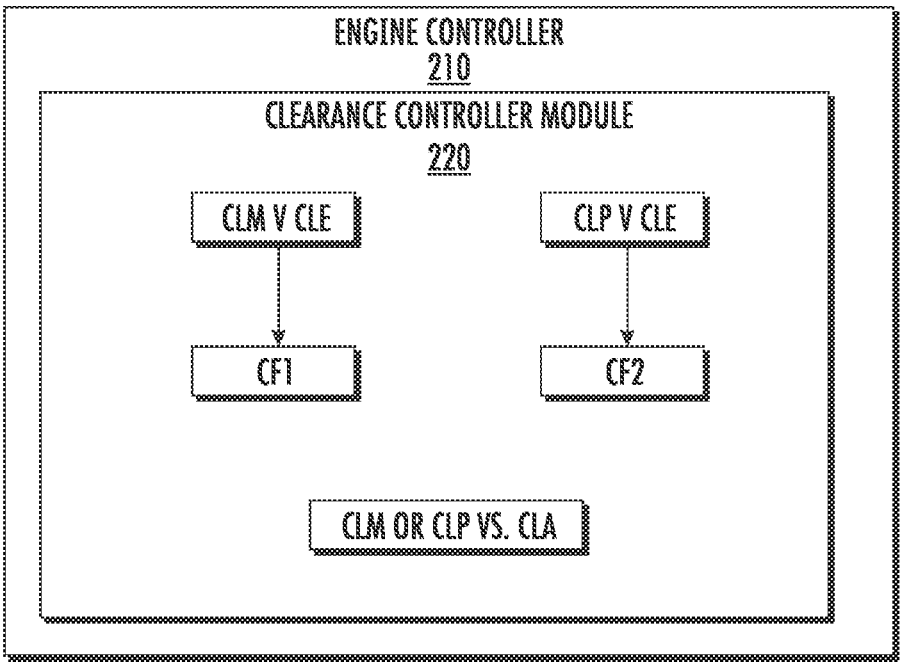
FIG. 7 provides a data flow diagram for an example clearance control scheme according to an example embodiment of the present disclosure.

As one example, with reference also now to FIG. 7 in addition to FIGS. 1, 3, and 4, a confidence score CF1 for the measured clearance CLM can be generated by comparing the measured clearance CLM to an expected clearance CLE. The expected clearance CLE can be determined based at least in part on fleet data 272 received from a data store 270. The fleet data 272 can correlate expected clearances for given operating points or operating conditions of gas turbine engines of a fleet, of which the gas turbine engine 100 is a part. The fleet data 272 can be based on actual clearances (measured or predicted) experienced by like or similar engines of the fleet for various operating points or conditions. Thus, based on the operating point or conditions of the gas turbine engine 100, an expected clearance CLE can be determined.

The confidence score CF1 can represent a degree in which the measured clearance CLM deviates from the expected clearance CLE, with larger deviations representing lower confidence scores and smaller deviations representing higher confidence scores. The confidence score CF1 for the measured clearance CLM can be represented as a percentage, for example. A confidence score CF2 for the predicted clearance CLP can be generated by comparing the predicted clearance CLP to the expected clearance CLE. The confidence score CF2 can represent a degree in which the predicted clearance CLP deviates from the expected clearance CLE, with larger deviations representing lower confidence scores and smaller deviations representing higher confidence scores. The confidence score CF2 for the predicted clearance CLP can be represented as a percentage, among other possible representations.

The clearance with the higher confidence score can be selected as the clearance used for comparison against the allowable clearance CLA. For instance, when the confidence score CF1 for the measured clearance CLM is higher than the confidence score CF2 for the predicted clearance CLP, then the measured clearance CLM is selected as the clearance CL used for comparison against the allowable clearance CLA. In contrast, when the confidence score CF2 for the predicted clearance CLP is higher than the confidence score CF1 for the measured clearance CLM, then the predicted clearance CLP is selected as the clearance CL used for comparison against the allowable clearance CLA. The clearance CL can be adjusted in any of the example ways provided herein.

One or more processors of the engine controller 210 can execute the clearance control module 220 to implement a fourth clearance control scheme. In implementing the fourth clearance control scheme, a measured clearance CLM is compared to an expected clearance CLE, which may be determined as noted above. When the measured clearance CLM is within a predetermined margin of the expected clearance CLE, e.g., by twenty percent (20%), the measured clearance CLM is selected as the clearance CL used for comparison against the allowable clearance CLA. When the measured clearance CLM is not within the predetermined margin of the expected clearance CLE, which may indicate a sensor malfunction, a predicted clearance CLP is selected as the clearance CL used for comparison against the allowable clearance CLA.

The predicted clearance CLP can be output from the one or more models 250, or alternatively, the predicted clearance CLP can be set as the expected clearance CLE. With the clearance CL selected as either the measured clearance CLM or the predicted clearance CLP, the one or more processors of the engine controller 210, in executing the clearance control module 220, can compare the clearance CL to the allowable clearance CLA. Then, the one or more processors of the engine controller 210, in executing the clearance control module 220, can determine a clearance setpoint for the clearance adjustment system based at least in part on a clearance difference CLΔ determined by comparing the selected clearance to the allowable clearance CLA. Further, the one or more processors of the engine controller 210, in executing the clearance control module 220, can then cause the clearance adjustment system to adjust the clearance CL between the rotating component and the stationary component of the gas turbine engine 100 based at least in part on the clearance setpoint CS. The clearance CL can be adjusted in any of the example ways provided herein.

Although the first, second, third, and fourth clearance control schemes have been described above with respect to adjusting a clearance between a rotating component and a stationary component, it will be appreciated that any one of the first, second, third, and fourth clearance control schemes can be implemented to adjust a clearance between two rotating components. For instance, in some embodiments, a gas turbine engine can include a first rotating component and a second rotating component rotatable relative to the first rotating component. A clearance may be defined between the first and second rotating components. Any one of the first, second, third, or fourth clearance control schemes can be implemented to adjust the clearance between the first and second rotating components.

Figure 8:
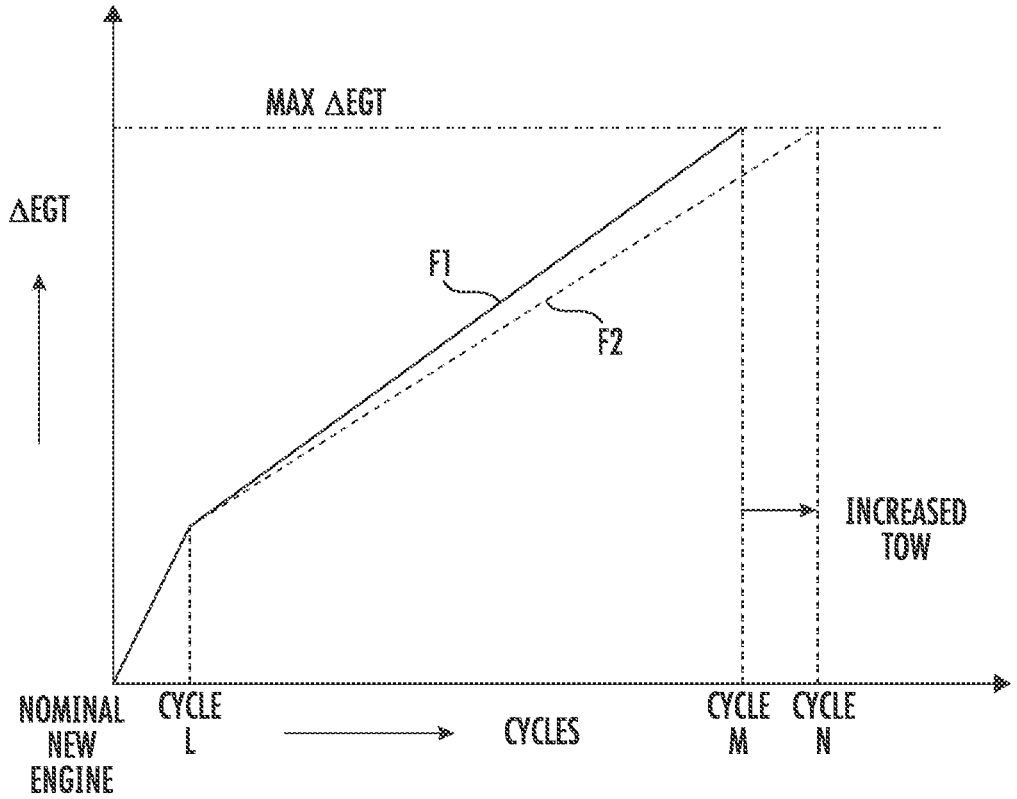
FIG. 8 provides a graph depicting a change in exhaust gas temperature as a function of engine cycles of a gas turbine engine according to an example embodiment of the present disclosure.
Figure 9:
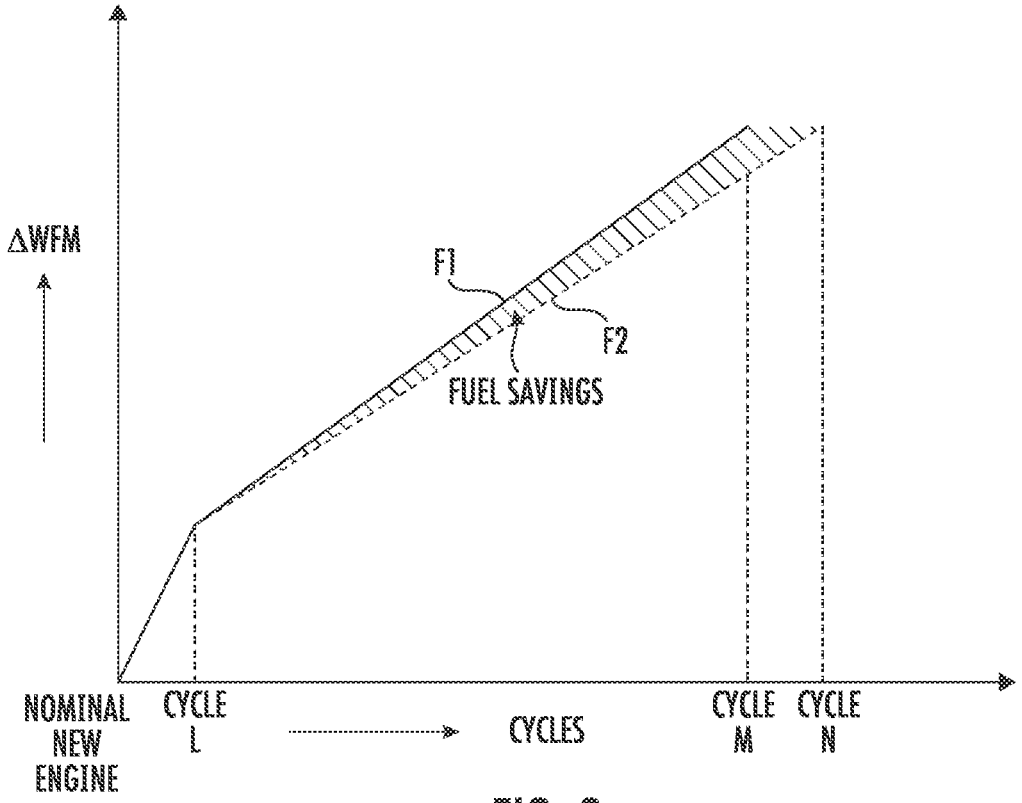
FIG. 9 provides a graph depicting a change in fuel flow to a gas turbine engine as a function of engine cycles of the gas turbine engine according to an example embodiment of the present disclosure.

FIGS. 8 and 9 graphically depict the advantages and benefits of the clearance control schemes provided herein. FIG. 8 depicts a change in exhaust gas temperature (ΔEGT)

as a function of engine cycles. FIG. 9 depicts a change in fuel flow (ΔWFM) to a gas turbine engine as a function of engine cycles.

As shown in FIG. 8, as a nominal new engine performs cycles, the change in exhaust gas temperature (ΔEGT) of the gas turbine engine increases. FIG. 8 depicts a first function F1 that represents how the change in exhaust gas temperature (ΔEGT) increases without implementation of one or more of the clearance control schemes provided herein. FIG. 8 also depicts a second function F2 that represents how the change in exhaust gas temperature (ΔEGT) increases with implementation of one or more of the clearance control schemes provided herein. As shown in the example in FIG. 8, the first function F1 reaches a maximum change in exhaust gas temperature at Cycle M, whereas the second function F2 reaches the maximum change in exhaust gas temperature at Cycle N, which is a greater cycle number than Cycle M. The increased TOW of the gas turbine engine utilizing the second function F2, which is representative of using one or more of the clearance control schemes provided herein, can thus be defined by a difference between Cycle N and Cycle M. As will be appreciated, increasing the TOW of an engine may have benefits.

As depicted in FIG. 9, as a nominal new engine performs cycles, the change in fuel flow (ΔWFM) to the gas turbine engine increases to provide a desired thrust despite deterioration of the gas turbine engine. FIG. 9 depicts a first function F1 that represents how the change in fuel flow (ΔWFM) increases without implementation of one or more of the clearance control schemes provided herein. FIG. 9 also depicts a second function F2 that represents how the change in fuel flow (ΔWFM) increases with implementation of one or more of the clearance control schemes provided herein. As shown in the example of FIG. 9, the first function F1 grows faster than the second function F2 and stops at Cycle M where the engine is removed because of the ΔEGT. The second function F2 continues on to Cycle N where the engine is also removed because of the ΔEGT. The fuel savings realized by the gas turbine engine utilizing the second function F2 is represented by the area defined between the first function F1 and the second function F2 as shown in FIG. 9.

Figure 10:
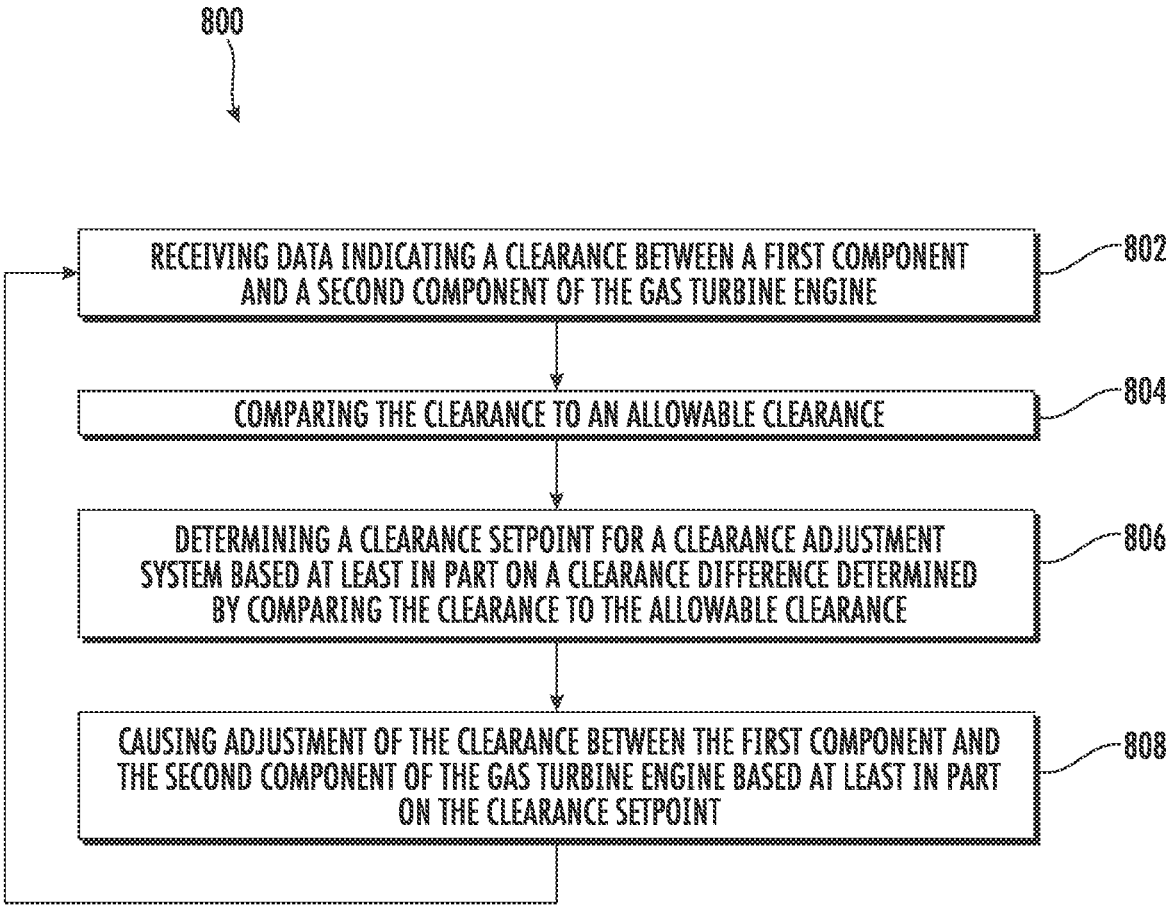
FIG. 10 provides a flow diagram for a method of adjusting a clearance between a first component and a second component of a gas turbine engine according to an example embodiment of the present disclosure.

FIG. 10 provides a flow diagram for a method 800 of adjusting a clearance between a first component and a second component of a gas turbine engine according to an example embodiment of the present disclosure. Some or all of the method 800 can be implemented by the engine controller 210 (FIG. 4) described herein, for example.

At 802, the method 800 includes receiving data indicating a clearance between a first component and a second component of the gas turbine engine. In some implementations, the second component is rotatable relative to the first component. In some implementations, the first component can be a stationary component. In other implementations, the first component can be a rotating component. For instance, in some implementations, the first component can be a shroud and the second component can be a turbine blade. In other implementations, the first component can be a shroud and the second component can be a compressor blade. In yet other implementations, the second component can be a component coupled with a shaft of the gas turbine engine and the first component can any suitable stationary component positioned spaced from but adjacent to the rotating component (e.g., within at least five centimeters) so as to define a clearance therebetween.

In some implementations, in receiving the data indicating the clearance, the method 800 includes receiving a measured clearance between the first component and the second component captured by a sensor of the gas turbine engine. In some implementations, in receiving the data indicating the clearance, the method 800 includes receiving a predicted clearance between the first component and the second component output by one or more models, the one or more models outputting the predicted clearance based at least in part on one or more operating parameter values indicating operating conditions of the gas turbine engine. The predicted clearance can be specific to the gas turbine engine at that point in time as it is based on the actual operating conditions associated with the gas turbine engine.

In yet other implementations, in receiving the data indicating the clearance, the method 800 includes receiving both a measured clearance and a predicted clearance. In such implementations, the method 800 can include receiving an expected clearance, the expected clearance being determined from fleet data that correlates clearances for one or more operating conditions of gas turbine engines of a fleet, the gas turbine engine being a part of the fleet. Further, the method 800 includes determining a confidence score for the measured clearance, the confidence score for the measured clearance representing a degree in which the measured clearance deviates from the expected clearance. The method 800 also includes determining a confidence score for the predicted clearance, the confidence score for the predicted clearance representing a degree in which the predicted clearance deviates from the expected clearance. The method 800 also includes selecting one of the measured clearance and the predicted clearance as the clearance to be compared to the allowable clearance at 804 based at least in part on the confidence score for the measured clearance and the confidence score for the predicted clearance. For instance, when the measured clearance has a higher confidence score than the predicted clearance, the measured clearance is selected as the clearance to be compared to the allowable clearance at 804. In contrast, when the predicted clearance has a higher confidence score than the measured clearance, the predicted clearance is selected as the clearance to be compared to the allowable clearance at 804.

In some further implementations, the method 800 includes receiving a measured clearance between the first component and the second component captured by a sensor of the gas turbine engine. The method 800 further includes comparing the measured clearance to an expected clearance, the expected clearance being determined from fleet data that correlates clearances for one or more operating conditions of gas turbine engines of a fleet, the gas turbine engine being a part of the fleet. Moreover, the method 800 includes determining whether the measured clearance is within a predetermined margin of the expected clearance, e.g., within ten percent (10%) of the expected clearance, within twenty percent (20%) of the expected clearance, etc. The method 800 further includes selecting one of the measured clearance and a predicted clearance as the clearance to be compared to the allowable clearance at 804 based at least in part on whether the measured clearance is within the predetermined margin of the expected clearance, wherein the predicted clearance is output by one or more models (e.g., the one or more models 250 of FIG. 4) based at least in part on one or more operating parameter values indicating operating conditions of the gas turbine engine.

At 804, the method 800 includes comparing the clearance to an allowable clearance. The allowable clearance is determined based at least in part on operating conditions associated with the gas turbine engine, which can be determined by one or more operating parameter values received or calculated. In some implementations, the clearance compared to the allowable clearance is a measured clearance measured or captured by a sensor of the gas turbine engine. In other implementations, the clearance compared to the allowable clearance is a predicted clearance output by the one or more models based at least in part on one or more operating parameter values received from one or more sensors of the gas turbine engine. The clearance can be compared to the allowable clearance to determine a clearance difference. For instance, the clearance difference can be determined by subtracting the allowable clearance from the clearance.

At 806, the method 800 includes determining a clearance setpoint for a clearance adjustment system based at least in part on the clearance difference determined by comparing the clearance to the allowable clearance. For a given set of operating conditions, the clearance setpoint can be dynamically adjusted based on the clearance difference.

For instance, in some implementations, the method 800 can include determining whether the clearance difference satisfies a threshold. In such implementations, when the clearance difference satisfies the threshold, the clearance setpoint for the clearance adjustment system is adjusted, or stated differently, the clearance setpoint is determined as being different than a past clearance setpoint, the past clearance setpoint being determined based at least in part on a past clearance difference determined by comparing a past clearance to the allowable clearance. As one example, the clearance setpoint can be adjusted from its nominal value when the clearance difference satisfies the threshold. As another example, the clearance setpoint can be adjusted from its most recent value used for the given operating conditions/allowable clearance when the clearance difference satisfies the threshold.

In other implementations, the clearance setpoint is determined based at least in part on a plurality of clearance differences, including the clearance difference of the present iteration of the clearance control scheme. Each one of the plurality of clearance differences can be determined by comparing the clearance at that point in time with the allowable clearance. In such implementations, the method further includes determining whether a predetermined number of clearance differences of the plurality of clearance differences satisfy a threshold. When the predetermined number of clearance differences of the plurality of clearance differences satisfy the threshold, the clearance setpoint for the clearance adjustment system is determined as being different than a past clearance setpoint determined based at least in part on a past clearance difference determined by comparing a past clearance to the allowable clearance.

In yet other implementations, the clearance setpoint is determined based at least in part on a plurality of clearance differences, including the clearance difference of the present iteration of the clearance control scheme. Each one of the plurality of clearance differences can be determined by comparing the clearance at that point in time with the allowable clearance. In such implementations, the method further includes determining whether a predetermined number of clearance differences of the plurality of clearance differences satisfy a threshold for a predetermined number of consecutive iterations of the clearance control scheme. When the predetermined number of clearance differences of the plurality of clearance differences satisfy the threshold for the predetermined number of consecutive iterations, the clearance setpoint for the clearance adjustment system is determined as being different than a past clearance setpoint determined based at least in part on a past clearance difference determined by comparing a past clearance to the allowable clearance.

At 808, the method 800 includes adjusting the clearance between the first component and the second component of the gas turbine engine based at least in part on the clearance setpoint. For instance, one or more processors of the engine controller can cause one or more controllable devices, such as one or more control valves of an active clearance control system, to adjust the clearance between the first component and the second component, which ultimately drives the clearance toward or to the allowable clearance. For example, based on the determined clearance setpoint, the one or more processors can generate one or more control signals. The one or more control signals, when received by one or more controllable devices, can cause the one or more controllable devices to adjust the clearance between the first component and the second component to the allowable clearance.

In some implementations, as depicted in FIG. 8, the method 800 can include continuously and/or periodically iterating the receiving at 802, the comparing at 804, the determining at 806, and the adjusting 808.

In some further implementations, the gas turbine engine can include a high pressure turbine, and wherein, the first component and the second component are components of the high pressure turbine. Further, the gas turbine engine can include a low pressure turbine having a first component, such as a shroud, and a second component, such as a low pressure turbine blade. In such implementations, the method 800 can include comparing a clearance between the first component and the second component of the low pressure turbine to an allowable clearance specific to the low pressure turbine. The method 800 can also include determining a clearance setpoint associated with the low pressure turbine based at least in part on a clearance difference determined by comparing the clearance between the first component and the second component of the low pressure turbine to the allowable clearance specific to the low pressure turbine. Further, the method 800 can include causing adjustment or adjusting the clearance between the first component and the second component of the low pressure turbine based at least in part on the clearance setpoint associated with the low pressure turbine. In this regard, the clearance between the first component and the second component of the low pressure turbine and the clearance between the first component and the second component of the high pressure turbine are adjusted based on at least two separate clearance setpoints specific to their respective turbines.

The clearance between the first component and the second component of the low pressure turbine and the clearance between the first component and the second component of the high pressure turbine can be adjusted independently of one another. For instance, in some implementations, the gas turbine engine can include an active clearance control system having a first control valve and a second control valve, e.g., as shown in FIG. 1. In such implementations, in causing adjustment of the clearance between the first component and the second component of the high pressure turbine and in causing adjustment of the clearance between the first component and the second component of the low pressure turbine, the method 800 can include causing the first control valve to modulate to control thermal control air to the high pressure turbine and causing the second control valve to modulate to control thermal control air to the low pressure turbine.

In other implementations, the clearance between the first component and the second component of the low pressure turbine and the clearance between the first component and the second component of the high pressure turbine can be adjusted collectively. The gas turbine engine can include a clearance adjustment system, such as an active clearance control system having a control valve (shown in FIG. 2). In such implementations, in causing adjustment of the clearance between the first component and the second component of the high pressure turbine and in causing adjustment of the clearance between the first component and the second component of the low pressure turbine, the method 800 can include causing the control valve to modulate to control thermal control air to the high pressure turbine and the low pressure turbine.

Figure 11:
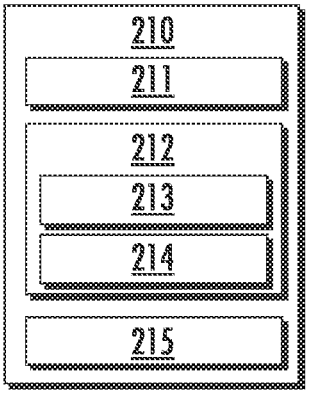
FIG. 11 provides a block diagram of an engine controller according to an example embodiment of the present disclosure.

FIG. 11 provides a block diagram of the engine controller 210 according to example embodiments of the present disclosure. As shown, the engine controller 210 can include one or more processor(s) 211 and one or more memory device(s) 212. The one or more processor(s) 211 can include any suitable processing device, such as a microprocessor, microcontroller, integrated circuit, logic device, and/or other suitable processing device. The one or more memory device (s) 212 can include one or more computer-executable or computer-readable media, including, but not limited to, non-transitory computer-readable media, RAM, ROM, hard drives, flash drives, and/or other memory devices.

The one or more memory device(s) 212 can store information accessible by the one or more processor(s) 211, including computer-readable or computer-executable instructions 213 that can be executed by the one or more processor(s) 211. The instructions 213 can include any set of instructions that, when executed by the one or more processor(s) 211, cause the one or more processor(s) 211 to perform operations. The instructions 213 can include the clearance control module 220 (FIG. 4). The instructions 213 can be software written in any suitable programming language or can be implemented in hardware. Additionally, and/or alternatively, the instructions 213 can be executed in logically and/or virtually separate threads on processor(s) 211. The memory device(s) 212 can further store data 214 that can be accessed by the processor(s) 211. For example, the data 214 can include models, lookup tables, databases, etc. The data 214 can include the sensor data 240, health data 262, and fleet data 272 of FIG. 4.

The engine controller 210 can also include a network interface 215 used to communicate, for example, with the other devices communicatively coupled thereto (e.g., via a communication network). The network interface 215 can include any suitable components for interfacing with one or more network(s), including for example, transmitters, receivers, ports, controllers, antennas, and/or other suitable components. One or more devices can be configured to receive one or more commands, control signals, and/or data from the engine controller 210 or provide one or more commands, control signals, and/or data to the engine controller 210.

The technology discussed herein makes reference to computer-based systems and actions taken by and information sent to and from computer-based systems. It will be appreciated that the inherent flexibility of computer-based systems allows for a great variety of possible configurations, combinations, and divisions of tasks and functionality between and among components. For instance, processes discussed herein can be implemented using a single computing device or multiple computing devices working in combination. Databases, memory, instructions, and applications can be implemented on a single system or distributed across multiple systems. Distributed components can operate sequentially or in parallel.

This written description uses examples to disclose the present disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

To summarize, the dynamic clearance control schemes provided herein may allow for dynamic adjustment of the clearance setpoint. Dynamic adjustment of the clearance setpoint may be based at least in part on one of a measured clearance captured by a sensor and a predicted clearance specific to the gas turbine engine at that point in time. In this regard, engine deterioration specific to the engine in question is accounted for in setting the clearance setpoint. The dynamic clearance control schemes provided herein may provide one or more benefits, advantages, and/or technical effects, such as a fuel burn benefit and exhaust gas temperature reduction, thereby improving the TOW or service of the gas turbine engine.

Further aspects are provided by the subject matter of the following clauses:

1. A gas turbine engine, comprising: a first component; a second component rotatable relative to the first component, a clearance being defined between the first component and the second component; a clearance adjustment system; and an engine controller having one or more processors configured to implement a clearance control scheme, in implementing the clearance control scheme, the one or more processors are configured to: receive data indicating a clearance between the first component and the second component, the clearance being at least one of a measured clearance captured by a sensor and a predicted clearance specific to the gas turbine engine at that point in time; compare the clearance to an allowable clearance, the allowable clearance being determined based at least in part on operating conditions associated with the gas turbine engine; determine a clearance setpoint for the clearance adjustment system based at least in part on a clearance difference determined by comparing the clearance to the allowable clearance; and cause the clearance adjustment system to adjust the clearance to the allowable clearance based at least in part on the clearance setpoint.

2. The gas turbine engine of any preceding clause, wherein the one or more processors are further configured to: determine whether the clearance difference satisfies a threshold, and wherein when the clearance difference satisfies the threshold, the clearance setpoint for the clearance adjustment system is determined as being different than a past clearance setpoint, the past clearance setpoint being determined based at least in part on a past clearance difference determined by comparing a past clearance to the allowable clearance.

3. The gas turbine engine of any preceding clause, wherein the clearance setpoint is determined based at least in part on a plurality of clearance differences, the clearance difference being one of the plurality of clearance differences, each one of the plurality of clearance differences being determined by comparing the clearance at that point in time with the allowable clearance.

4. The gas turbine engine of any preceding clause, wherein the one or more processors are further configured to: determine whether a predetermined number of clearance differences of the plurality of clearance differences satisfy a threshold, and wherein when the predetermined number of clearance differences of the plurality of clearance differences satisfy the threshold, the clearance setpoint for the clearance adjustment system is determined as being different than a past clearance setpoint determined based at least in part on a past clearance difference determined by comparing a past clearance to the allowable clearance.

5. The gas turbine engine of any preceding clause, wherein the one or more processors are further configured to: determine whether a predetermined number of clearance differences of the plurality of clearance differences satisfy a threshold for a predetermined number of consecutive iterations of the clearance control scheme, and wherein when the predetermined number of clearance differences of the plurality of clearance differences satisfy the threshold for the predetermined number of consecutive iterations of the clearance control scheme, the clearance setpoint for the clearance adjustment system is determined as being different than a past clearance setpoint determined based at least in part on a past clearance difference determined by comparing a past clearance to the allowable clearance.

6. The gas turbine engine of any preceding clause, wherein the one or more processors are configured to continuously iterate the clearance control scheme.

7. The gas turbine engine of any preceding clause, wherein in receiving the data indicating the clearance, the one or more processors of the engine controller are configured to: receive a measured clearance between the first component and the second component captured by the sensor of the gas turbine engine; and receive a predicted clearance between the first component and the second component output by one or more models, the one or more models outputting the predicted clearance based at least in part on one or more operating parameter values indicating the operating conditions of the gas turbine engine.

8. The gas turbine engine of any preceding clause, wherein the one or more processors of the engine controller are further configured to: receive an expected clearance, the expected clearance being determined from fleet data that correlates clearances to operating conditions of gas turbine engines of a fleet, the gas turbine engine being a part of the fleet; determine a confidence score for the measured clearance, the confidence score for the measured clearance representing a degree in which the measured clearance deviates from the expected clearance; determine a confidence score for the predicted clearance, the confidence score for the predicted clearance representing a degree in which the predicted clearance deviates from the expected clearance; and select one of the measured clearance and the predicted clearance as the clearance to be compared to the allowable clearance based at least in part on the confidence score for the measured clearance and the confidence score for the predicted clearance.

9. The gas turbine engine of any preceding clause, wherein the one or more processors of the engine controller are further configured to: receive a measured clearance between the first component and the second component captured by the sensor of the gas turbine engine; compare the measured clearance to an expected clearance, the expected clearance being determined from fleet data that correlates clearances to operating conditions of gas turbine engines of a fleet, the gas turbine engine being a part of the fleet; determine whether the measured clearance is within a predetermined margin of the expected clearance; and select one of the measured clearance and a predicted clearance as the clearance to be compared to the allowable clearance based at least in part on whether the measured clearance is within the predetermined margin of the expected clearance, the predicted clearance being output by one or more models based at least in part on one or more operating parameter values indicating the operating conditions of the gas turbine engine.

10. The gas turbine engine of any preceding clause, further comprising: a high pressure turbine, wherein the first component and the second component are components of the high pressure turbine; and a low pressure turbine having a first component and a second component, and wherein the one or more processors of the engine controller are further configured to: receive data indicating a clearance between the first component and the second component of the low pressure turbine; compare the clearance between the first component and the second component of the low pressure turbine to an allowable clearance specific to the low pressure turbine; determine a clearance setpoint specific to the low pressure turbine based at least in part on a clearance difference determined by comparing the clearance specific to the low pressure turbine to the allowable clearance specific to the low pressure turbine; and cause the clearance adjustment system to adjust the clearance specific to the low pressure turbine to the allowable clearance based at least in part on the clearance setpoint specific to the low pressure turbine.

11. The gas turbine engine of any preceding clause, wherein the clearance adjustment system is an active clearance control system having a first control valve and a second control valve, and wherein in causing the clearance adjustment system to adjust the clearance between the first component and the second component of the high pressure turbine and in causing the clearance adjustment system to adjust the clearance specific to the low pressure turbine, the one or more processors of the engine controller are further configured to: cause the first control valve to modulate to control thermal control air to the high pressure turbine; and cause the second control valve to modulate to control thermal control air to the low pressure turbine.

12. The gas turbine engine of any preceding clause, wherein the clearance adjustment system is an active clearance control system having a control valve, and wherein in causing the clearance adjustment system to adjust the clearance between the first component and the second component of the high pressure turbine and in causing the clearance adjustment system to adjust the clearance between the first component and the second component of the low pressure turbine, the one or more processors of the engine controller are further configured to: cause the control valve to modulate to control thermal control air to the high pressure turbine and the low pressure turbine.

13. The gas turbine engine of any preceding clause, wherein the first component is a shroud and the second component is one of a turbine blade and a compressor blade.

14. The gas turbine engine of any preceding clause, wherein the clearance is the measured clearance measured by the sensor.

15. The gas turbine engine of any preceding clause, wherein the engine controller includes one or more models, and wherein the clearance is the predicted clearance output by the one or more models.

16. A method of implementing a clearance control scheme for controlling clearances of a gas turbine engine, the method comprising: receiving data indicating a clearance between a first component and a second component of the gas turbine engine, the clearance being at least one of a measured clearance captured by a sensor and a predicted clearance specific to the gas turbine engine at that point in time; comparing the clearance to an allowable clearance, the allowable clearance being determined based at least in part on operating conditions associated with the gas turbine engine; determining a clearance setpoint for a clearance adjustment system based at least in part on a clearance difference determined by comparing the clearance to the allowable clearance; and adjusting, by the clearance adjustment system, the clearance to the allowable clearance based at least in part on the clearance setpoint.

17. The method of any preceding clause, further comprising: determining whether the clearance difference satisfies a threshold, and wherein when the clearance difference satisfies the threshold, the clearance setpoint for the clearance adjustment system is determined as being different than a past clearance setpoint, the past clearance setpoint being determined based at least in part on a past clearance difference determined by comparing a past clearance to the allowable clearance.

18. The method of any preceding clause, wherein the clearance setpoint is determined based at least in part on a plurality of clearance differences, the clearance difference being one of the plurality of clearance differences, each one of the plurality of clearance differences being determined by comparing the clearance at that point in time with the allowable clearance, and wherein the method further comprises: determining whether a predetermined number of clearance differences of the plurality of clearance differences satisfy a threshold, and wherein when the predetermined number of clearance differences of the plurality of clearance differences satisfy the threshold, the clearance setpoint for the clearance adjustment system is determined as being different than a past clearance setpoint determined based at least in part on a past clearance difference determined by comparing a past clearance to the allowable clearance.

19. The gas turbine engine of any preceding clause, wherein the clearance setpoint is determined based at least in part on a plurality of clearance differences, the clearance difference being one of the plurality of clearance differences, each one of the plurality of clearance differences being determined by comparing the clearance at that point in time with the allowable clearance, and wherein the method further comprises: determining whether a predetermined number of clearance differences of the plurality of clearance differences satisfy a threshold for a predetermined number of consecutive iterations of the clearance control scheme, and wherein when the predetermined number of clearance differences of the plurality of clearance differences satisfy the threshold for a predetermined number of consecutive iterations of the clearance control scheme, the clearance setpoint for the clearance adjustment system is determined as being different than a past clearance setpoint determined based at least in part on a past clearance difference determined by comparing a past clearance to the allowable clearance.

20. A non-transitory computer readable medium comprising computer-executable instructions, which, when executed by one or more processors of a controller of a gas turbine engine, cause the controller to implement a clearance control scheme, in implementing the clearance control scheme, the one or more processors are configured to: receive data indicating a clearance between a first component and a second component of the gas turbine engine, the clearance being at least one of a measured clearance captured by a sensor and a predicted clearance specific to the gas turbine engine at that point in time; compare the clearance to an allowable clearance, the allowable clearance being determined based at least in part on operating conditions associated with the gas turbine engine; determine a clearance setpoint for a clearance adjustment system based at least in part on a clearance difference determined by comparing the clearance to the allowable clearance; and cause the clearance adjustment system to adjust the clearance to the allowable clearance based at least in part on the clearance setpoint.

What is claimed is:

1. A gas turbine engine, comprising:

a clearance adjustment system; and an engine controller having one or more processors configured to implement a clearance control scheme, in implementing the clearance control scheme, the one or more processors are configured to:

receive data indicating a clearance between a first component and a second component rotatable relative to the first component, the clearance being at least one of a measured clearance captured by a sensor and a predicted clearance specific to the gas turbine engine at that point in time;

compare the clearance to an allowable clearance, the allowable clearance being determined based at least in part on operating conditions associated with the gas turbine engine;

determine a clearance setpoint for the clearance adjustment system based at least in part on a clearance difference determined by comparing the clearance to the allowable clearance; and cause the clearance adjustment system to adjust the clearance to the allowable clearance based at least in part on the clearance setpoint;

wherein in receiving the data indicating the clearance, the one or more processors of the engine controller are configured to:

receive a measured clearance between the first component and the second component captured by the sensor of the gas turbine engine; and receive a predicted clearance between the first component and the second component output by one or more models, the one or more models outputting the predicted clearance based at least in part on one or more operating parameter values indicating the operating conditions of the gas turbine engine.

2. The gas turbine engine of claim 1, wherein the one or more processors are further configured to:

determine whether the clearance difference satisfies a threshold, and wherein when the clearance difference satisfies the threshold, the clearance setpoint for the clearance adjustment system is determined as being different than a past clearance setpoint, the past clearance setpoint being determined based at least in part on a past clearance difference determined by comparing a past clearance to the allowable clearance.

3. The gas turbine engine of claim 1, wherein the clearance setpoint is determined based at least in part on a plurality of clearance differences, the clearance difference being one of the plurality of clearance differences, each one of the plurality of clearance differences being determined by comparing the clearance at that point in time with the allowable clearance.

4. The gas turbine engine of claim 3, wherein the one or more processors are further configured to:

determine whether a predetermined number of clearance differences of the plurality of clearance differences satisfy a threshold, and wherein when the predetermined number of clearance differences of the plurality of clearance differences satisfy the threshold, the clearance setpoint for the clearance adjustment system is determined as being different than a past clearance setpoint determined based at least in part on a past clearance difference determined by comparing a past clearance to the allowable clearance.

5. The gas turbine engine of claim 3, wherein the one or more processors are further configured to:

determine whether a predetermined number of clearance differences of the plurality of clearance differences satisfy a threshold for a predetermined number of consecutive iterations of the clearance control scheme, and wherein when the predetermined number of clearance differences of the plurality of clearance differences satisfy the threshold for the predetermined number of consecutive iterations of the clearance control scheme, the clearance setpoint for the clearance adjustment system is determined as being different than a past clearance setpoint determined based at least in part on a past clearance difference determined by comparing a past clearance to the allowable clearance.

6. The gas turbine engine of claim 1, wherein the one or more processors are configured to continuously iterate the clearance control scheme.

7. The gas turbine engine of claim 1, wherein the one or more processors of the engine controller are further configured to:

receive an expected clearance, the expected clearance being determined from fleet data that correlates clearances to operating conditions of gas turbine engines of a fleet, the gas turbine engine being a part of the fleet;

determine a confidence score for the measured clearance, the confidence score for the measured clearance representing a degree in which the measured clearance deviates from the expected clearance;

determine a confidence score for the predicted clearance, the confidence score for the predicted clearance representing a degree in which the predicted clearance deviates from the expected clearance; and select one of the measured clearance and the predicted clearance as the clearance to be compared to the allowable clearance based at least in part on the confidence score for the measured clearance and the confidence score for the predicted clearance.

8. The gas turbine engine of claim 1, wherein the one or more processors of the engine controller are further configured to:

receive a measured clearance between the first component and the second component captured by the sensor of the gas turbine engine;

compare the measured clearance to an expected clearance, the expected clearance being determined from fleet data that correlates clearances to operating conditions of gas turbine engines of a fleet, the gas turbine engine being a part of the fleet;

determine whether the measured clearance is within a predetermined margin of the expected clearance; and select one of the measured clearance and a predicted clearance as the clearance to be compared to the allowable clearance based at least in part on whether the measured clearance is within the predetermined margin of the expected clearance, the predicted clearance being output by one or more models based at least in part on one or more operating parameter values indicating the operating conditions of the gas turbine engine.

9. The gas turbine engine of claim 1, further comprising:

a high pressure turbine, wherein the first component and the second component are components of the high pressure turbine; and a low pressure turbine having a first component and a second component, and wherein the one or more processors of the engine controller are further configured to:

receive data indicating a clearance between the first component and the second component of the low pressure turbine;

compare the clearance between the first component and the second component of the low pressure turbine to an allowable clearance specific to the low pressure turbine;

determine a clearance setpoint specific to the low pressure turbine based at least in part on a clearance difference determined by comparing the clearance specific to the low pressure turbine to the allowable clearance specific to the low pressure turbine; and cause the clearance adjustment system to adjust the clearance specific to the low pressure turbine to the allowable clearance based at least in part on the clearance setpoint specific to the low pressure turbine.

10. The gas turbine engine of claim 9, wherein the clearance adjustment system is an active clearance control system having a first control valve and a second control valve, and wherein in causing the clearance adjustment system to adjust the clearance between the first component and the second component of the high pressure turbine and in causing the clearance adjustment system to adjust the clearance specific to the low pressure turbine, the one or more processors of the engine controller are further configured to:

cause the first control valve to modulate to control thermal control air to the high pressure turbine; and cause the second control valve to modulate to control thermal control air to the low pressure turbine.

11. The gas turbine engine of claim 9, wherein the clearance adjustment system is an active clearance control system having a control valve, and wherein in causing the clearance adjustment system to adjust the clearance between the first component and the second component of the high pressure turbine and in causing the clearance adjustment system to adjust the clearance between the first component and the second component of the low pressure turbine, the one or more processors of the engine controller are further configured to:

cause the control valve to modulate to control thermal control air to the high pressure turbine and the low pressure turbine.

12. The gas turbine engine of claim 1, wherein the first component is a shroud and the second component is one of a turbine blade and a compressor blade.

13. The gas turbine engine of claim 1, wherein the clearance is the measured clearance measured by the sensor.

14. The gas turbine engine of claim 1, wherein the engine controller includes one or more models, and wherein the clearance is the predicted clearance output by the one or more models.

15. A method of implementing a clearance control scheme for controlling clearances of a gas turbine engine, the method comprising:

comparing a clearance between a first component and a second component of the gas turbine engine to an allowable clearance, the clearance being at least one of a measured clearance captured by a sensor and a predicted clearance specific to the gas turbine engine at that point in time, the allowable clearance being determined based at least in part on operating conditions associated with the gas turbine engine;

determining a clearance setpoint for a clearance adjustment system based at least in part on a clearance difference determined by comparing the clearance to the allowable clearance; and adjusting, by the clearance adjustment system, the clearance to the allowable clearance based at least in part on the clearance setpoint;

wherein the clearance setpoint is determined based at least in part on a plurality of clearance differences, the clearance difference being one of the plurality of clearance differences, each one of the plurality of clearance differences being determined by comparing the clearance at that point in time with the allowable clearance, and wherein the method further comprises:

determining whether a predetermined number of clearance differences of the plurality of clearance differences satisfy a threshold, and wherein when the predetermined number of clearance differences of the plurality of clearance differences satisfy the threshold, the clearance setpoint for the clearance adjustment system is determined as being different than a past clearance setpoint determined based at least in part on a past clearance difference determined by comparing a past clearance to the allowable clearance.

16. The method of claim 15, further comprising:

determining whether the clearance difference satisfies a threshold, and wherein when the clearance difference satisfies the threshold, the clearance setpoint for the clearance adjustment system is determined as being different than a past clearance setpoint, the past clearance setpoint being determined based at least in part on a past clearance difference determined by comparing a past clearance to the allowable clearance.

17. The method of claim 15, wherein the method further comprises:

determining whether a predetermined number of clearance differences of the plurality of clearance differences satisfy a threshold for a predetermined number of consecutive iterations of the clearance control scheme, and wherein when the predetermined number of clearance differences of the plurality of clearance differences satisfy the threshold for a predetermined number of consecutive iterations of the clearance control scheme, the clearance setpoint for the clearance adjustment system is determined as being different than a past clearance setpoint determined based at least in part on a past clearance difference determined by comparing a past clearance to the allowable clearance.

18. A non-transitory computer readable medium comprising computer-executable instructions, which, when executed by one or more processors of a controller of a gas turbine engine, cause the controller to implement a clearance control scheme, in implementing the clearance control scheme, the one or more processors are configured to:

compare a clearance between a first component and a second component of the gas turbine engine to an allowable clearance, the clearance being at least one of a measured clearance captured by a sensor and a predicted clearance specific to the gas turbine engine at that point in time, the allowable clearance being determined based at least in part on operating conditions associated with the gas turbine engine;

determine a clearance setpoint for a clearance adjustment system based at least in part on a clearance difference determined by comparing the clearance to the allowable clearance; and cause the clearance adjustment system to adjust the clearance to the allowable clearance based at least in part on the clearance setpoint;

wherein the clearance setpoint is determined based at least in part on a plurality of clearance differences, the clearance difference being one of the plurality of clearance differences, each one of the plurality of clearance differences being determined by comparing the clearance at that point in time with the allowable clearance, and wherein the method further comprises:

determining whether a predetermined number of clearance differences of the plurality of clearance differences satisfy a threshold for a predetermined number of consecutive iterations of the clearance control scheme, and wherein when the predetermined number of clearance differences of the plurality of clearance differences satisfy the threshold for a predetermined number of consecutive iterations of the clearance control scheme, the clearance setpoint for the clearance adjustment system is determined as being different than a past clearance setpoint determined based at least in part on a past clearance difference determined by comparing a past clearance to the allowable clearance.

* * * * *